US011545286B2

(12) United States Patent
Kato et al.

(10) Patent No.: US 11,545,286 B2
(45) Date of Patent: Jan. 3, 2023

(54) CRYSTALLINE FE-BASED ALLOY POWDER AND METHOD FOR PRODUCING SAME

(71) Applicant: HITACHI METALS, LTD., Tokyo (JP)

(72) Inventors: Tetsuro Kato, Tokyo (JP); Nobuhiko Chiwata, Tokyo (JP); Motoki Ohta, Tokyo (JP); Shin Noguchi, Tokyo (JP); Shuji Yamanaka, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/636,766

(22) PCT Filed: Aug. 6, 2018

(86) PCT No.: PCT/JP2018/029476
§ 371 (c)(1),
(2) Date: Feb. 5, 2020

(87) PCT Pub. No.: WO2019/031464
PCT Pub. Date: Feb. 14, 2019

(65) Prior Publication Data

US 2020/0243238 A1 Jul. 30, 2020

(30) Foreign Application Priority Data

Aug. 7, 2017 (JP) ..... JP2017-152561

(51) Int. Cl.
*B22F 1/02* (2006.01)
*H01F 1/153* (2006.01)
(Continued)

(52) U.S. Cl.
CPC ..... *H01F 1/15333* (2013.01); *B22F 1/052* (2022.01); *B22F 1/16* (2022.01);
(Continued)

(58) Field of Classification Search
CPC .. H01F 1/15333; H01F 1/1535; B22F 1/0014; B22F 1/02; B22F 2301/35;
(Continued)

(56) References Cited

U.S. PATENT DOCUMENTS 7,744,702 B2 6/2010 Tomita et al.
7,847,460 B2 12/2010 Masuzawa et al.
(Continued)

FOREIGN PATENT DOCUMENTS

CN 101202139 A 6/2008
CN 101401278 A 4/2009
(Continued)

OTHER PUBLICATIONS

Machine Translation of JP2001196216A Yasuo Shimoda Jul. 2001 (Year: 2001).*
(Continued)

*Primary Examiner* — Seth Dumbris
(74) *Attorney, Agent, or Firm* — Westman, Champlin & Koehler, P.A.

(57) ABSTRACT

A crystalline Fe-based alloy powder composed of Fe-based alloy particles containing, within a structure thereof, nanocrystal grains having an average grain size of 30 nm or less, and in which d50, which is a particle diameter corresponding to a cumulative frequency of 50% by volume, is from 3.5 μm to 35.0 μm in a cumulative distribution curve that is obtained by laser diffractometry and that shows the relationship between the particle diameter and the cumulative frequency from the small particle diameter side, and a ratio of Fe-based alloy particles having a particle diameter of 2 μm or less to the total of the Fe-based alloy particles, which is determined by laser diffractometry, is from 0% by volume to 8% by volume.

16 Claims, 4 Drawing Sheets

(51) Int. Cl.

| | |
|---|---|
| ***C22C 38/00*** | (2006.01) |
| ***C22C 38/02*** | (2006.01) |
| ***C22C 38/20*** | (2006.01) |
| ***C22C 38/22*** | (2006.01) |
| ***C22C 38/26*** | (2006.01) |
| ***B22F 1/16*** | (2022.01) |
| ***B22F 1/052*** | (2022.01) |

(52) U.S. Cl.
CPC ..... *C22C 38/002* (2013.01); *C22C 38/02* (2013.01); *C22C 38/20* (2013.01); *C22C 38/22* (2013.01); *C22C 38/26* (2013.01); *H01F 1/1535* (2013.01); *B22F 2301/35* (2013.01); *B22F 2304/10* (2013.01); *C22C 2200/04* (2013.01); *C22C 2202/02* (2013.01)

(58) Field of Classification Search
CPC ... B22F 2304/10; C22C 38/002; C22C 38/02; C22C 38/20; C22C 38/22; C22C 38/26; C22C 2200/04; C22C 2200/02
USPC ..... 428/552
See application file for complete search history.

(56) References Cited

U.S. PATENT DOCUMENTS

| | | | | |
|---|---|---|---|---|
| 8,177,923 | B2 | 5/2012 | Ohta et al. | |
| 8,182,620 | B2 | 5/2012 | Ohta et al. | |
| 8,287,666 | B2 | 10/2012 | Ohta et al. | |
| 2008/0100410 | A1 | 5/2008 | Tomita et al. | |
| 2009/0085416 | A1 | 4/2009 | Masuzawa et al. | |
| 2009/0266448 | A1 | 10/2009 | Ohta et al. | |
| 2011/0085931 | A1 | 4/2011 | Ohta et al. | |
| 2011/0108167 | A1 | 5/2011 | Ohta et al. | |
| 2011/0227679 | A1* | 9/2011 | Koeda | H01F 1/26 335/297 |
| 2014/0001398 | A1* | 1/2014 | Takahashi | H01F 1/01 252/62.56 |
| 2015/0162118 | A1* | 6/2015 | Kato et al. | H01F 1/153 |
| 2015/0380149 | A1* | 12/2015 | Nakamura | H01F 41/0206 427/127 |
| 2017/0148554 | A1* | 5/2017 | Kudo | H01F 1/147 |
| 2017/0278618 | A1* | 9/2017 | Matsui | H01F 1/15383 |
| 2020/0238374 | A1* | 7/2020 | Chiba et al. | B22F 1/0018 |

FOREIGN PATENT DOCUMENTS

| | | | | |
|---|---|---|---|---|
| EP | 1 925 686 | A1 | 5/2008 | |
| JP | 64-079342 | A | 3/1989 | |
| JP | 2001-196216 | A | 7/2001 | |
| JP | 2004-349585 | A | 12/2004 | |
| JP | 2015-005550 | A | 1/2015 | |
| JP | 2016-015357 | A * | 1/2016 | B22F 3/006 |
| JP | 2016015357 | A | 1/2016 | |
| JP | 2016-025352 | A | 2/2016 | |
| JP | 2017-110256 | A | 6/2017 | |
| WO | WO-2018221015 | A1 * | 12/2018 | H01F 27/29 |

OTHER PUBLICATIONS

C. Shade et al. "Atomization" (2015), ASM Internation, vol. 7, p. 58-71 (Year: 2015).*

T. Osaka et al. "A soft magnetic CoNiFe film with high saturation magnetic flux density and low coercivity" (1998), Nature, 392, p. 796-798 (Year: 1998).*

M. Anhalt "Systematic investigation of particle size dependence of magnetic properties in soft magnetic composites" (2008), Journal of Magnetism and Magnetic Materials, 320(14), p. e336-369. (Year: 2008).*

Horiba, "Understanding and Interpreting Particle Size Distribution Calculations" (Year: 2020).*

Lee et al. "Magnetic multi-granule nanoclusters: A model system that exhibits universal size effect of magnetic coercivity" 2015, Scientific Reports, 5, 12135, p. 1-7. (Year: 2015).*

G. Zhao et al. "Enhanced magnetic properties of Fe soft magnetic composites by surface oxidation," 2016, Journal of Magnetism and Magnetic Materials, 399, p. 51-57. (Year: 2016).*

T.H. Kim et al. "High-frequency magnetic properties of soft magnetic cores based on nanocrystalline alloy powder prepared by thermal oxidation," 2010, Journal of Magnetism and Magnetic Materials, 322, p. 2423-2427. (Year: 2010).*

S. Nakahara et al. "Electric insulation ofa FeSiBC soft magnetic amorphous powder by a wet chemical method: Identification of the oxide layer and its thickness control," 2010, Acta Materialia, 58, p. 5695-5703. (Year: 2010).*

Extended European search report for European Patent Application No. 18843065.6, dated Jan. 13, 2021, 8 pages.

International Search Report and Written Opinion for International Application No. PCT/JP2018/029476, dated Oct. 23, 2018, 15 pages.

First Office Action, including Search Report, for Chinese Patent Application No. 201880051422.8, dated Sep. 28, 2021, 15 pages.

Kinsei Z. et al., "Powder and the effect of particle size on the magnetic properties of products," Magnetic Materials and Devices, pp. 68-69, dated Jul. 31, 1985.

* cited by examiner

CRYSTALLINE FE-BASED ALLOY POWDER AND METHOD FOR PRODUCING SAME

TECHNICAL FIELD

The present disclosure relates to a crystalline Fe-based alloy powder and a method for producing the same.

BACKGROUND ART

Conventionally, Fe-based alloy powders composed of Fe-based alloy particles are known.

For example, Patent Document 1 discloses, as a Fe-based soft magnetic alloy that has excellent soft magnetic properties (especially, a high frequency magnetic property) and a low magnetostriction and exhibits little degradation in properties due to impregnation, deformation, or the like, a Fe-based soft magnetic alloy that is characterized by having a composition represented by Formula: $(Fe_{1-a}M_a)_{100-x-y-z-\alpha}Cu_xSi_yB_zM'_\alpha$ (wherein M represents Co and/or Ni, M' represents at least one element selected from the group consisting of Nb, W, Ta, Zr, Hf, Ti and Mo, and a, x, y, z, and α satisfy $0 \le a \le 0.5$, $0.1 \le x \le 3$, $0 \le y \le 30$, $0 \le z \le 25$, $5 \le y+z \le 30$, and $0.1 \le \alpha \le 30$, respectively), and in which at least 50% of the structure is composed of fine crystal grains. On page 9 of Patent Document 1, as the above Fe-based soft magnetic alloy, a powdery one is disclosed.

Patent Document 2 discloses, as a FeSiBNbCu type soft magnetic metal powder for producing a power inductor excellent in saturation current, inductance, magnetic permeability, and a core loss value, a spherical FeSiBNbCu type soft magnetic metal powder in which nanocrystal grains are formed.

Patent Document 3 discloses, as a soft magnetic powder capable of ensuring high insulation properties between particles when the powder is compacted, a soft magnetic powder that has a composition represented by $Fe_{100-a-b-c-d-e-f}Cu_aSi_bB_cM_dM'_eX_f$ (atom %) (wherein, M represents at least one element selected from the group consisting of Nb, W, Ta, Zr, Hf, Ti, and Mo, M' represents at least one element selected from the group consisting of V, Cr, Mn, Al, a platinum group element, Sc, Y, Au, Zn, Sn, and Re, X represents at least one element selected from the group consisting of C, P, Ge, Ga, Sb, In, Be, and As, and a, b, c, d, e, and f are numbers that satisfy $0.1 \le a \le 3$, $0 \le b \le 30$, $0 \le c \le 25$, $5 \le b+c \le 30$, $0.1 \le d \le 30$, $0 \le e \le 10$, and $0 \le f \le 10$), in which a crystal structure with a grain size of from 1 nm to 30 nm is included in an amount of 40% by volume or more, and in which, when the soft magnetic powder is subjected to a classification treatment using a JIS standard sieve having an opening of 45 μm, a JIS standard sieve having an opening of 38 μm, and a JIS standard sieve having an opening of 25 μm in this order and when particles that pass through the JIS standard sieve having an opening of 45 μm but do not pass through the JIS standard sieve having an opening of 38 μm are taken as first particles, particles that pass through the JIS standard sieve having an opening of 38 μm but do not pass through the JIS standard sieve having an opening of 25 μm are taken as second particles, and particles that pass through the JIS standard sieve having an opening of 25 μm are taken as third particles, coercive force Hc1 of the first particles, coercive force Hc2 of the second particles, and coercive force Hc3 of the third particles satisfy the relationship that Hc2/Hc1 is from 0.85 to 1.4 and Hc3/Hc1 is from 0.5 to 1.5.

Patent Document 4 discloses, as a method for producing a dust core having excellent magnetic properties, a method for producing a dust core, the method including molding and fixing a magnetic powder that is a nanocrystal magnetic powder in which at least 50% or more of the structure has a nanocrystal structure with a crystal grain size of 100 nm or less, or an amorphous magnetic powder having a composition capable of forming the above nanocrystal structure by heat treatment, wherein the magnetic powder is produced by a water atomization method and has a composition represented by Formula: $Fe_{(100-X-Y-Z-\alpha-\beta)}B_XSi_YCu_ZM_\alpha M'_\beta$ (atom %) (wherein M represents at least one element selected from the group consisting of Nb, W, Ta, Zr, Hf, Ti, and Mo, M' represents at least one element selected from the group consisting of V, Cr, Mn, Al, a platinum group element, Sc, Y, Au, Zn, Sn, Re, and Ag, and X, Y, Z, α, and β satisfy $12 \le X \le 15$, $0 \le Y \le 15$, $0.1 \le Z \le 3$, $0.1 \le \alpha \le 30$, and $0 \le \beta \le 10$, respectively).

Patent Document 1: Japanese Patent Application Laid-Open (JP-A) No. S64-079342

Patent Document 2: JP-A No. 2016-25352

Patent Document 3: JP-A No. 2017-110256

Patent Document 4: JP-A No. 2004-349585

SUMMARY OF INVENTION

Technical Problem

An object of one aspect of the present disclosure is to provide a crystalline Fe-based alloy powder having a reduced coercive force.

An object of another aspect of the present invention is to provide a method for producing a crystalline Fe-based alloy powder, the method being capable of producing a crystalline Fe-based alloy powder having a reduced coercive force.

Solution to Problem

Means for addressing the above problems include the following aspects.

<1> A crystalline Fe-based alloy powder composed of Fe-based alloy particles that contain, within a structure thereof, nanocrystal grains having an average grain size of 30 nm or less, wherein:

d50, which is a particle diameter corresponding to a cumulative frequency of 50% by volume, is from 3.5 μm to 35.0 μm in a cumulative distribution curve that is obtained by laser diffractometry and that shows the relationship between the particle diameter and the cumulative frequency from the small particle diameter side; and a ratio of Fe-based alloy particles having a particle diameter of 2 μm or less to the total of the Fe-based alloy particles, which is determined by laser diffractometry, is from 0% by volume to 8% by volume.

<2> The crystalline Fe-based alloy powder according to <1>, wherein, in the cumulative distribution curve, in a case in which d10 is a particle diameter corresponding to a cumulative frequency of 10% by volume and d90 is a particle diameter corresponding to a cumulative frequency of 90% by volume, (d90−10)/d50 is from 1.00 to 4.00.

<3> The crystalline Fe-based alloy powder according to <1> or <2>, wherein a coercive force at an applied magnetic field of 40 kA/m is 190 A/m or less.

<4> The crystalline Fe-based alloy powder according to any one of <1> to <3>, wherein the ratio of Fe-based alloy particles having a particle diameter of 2 μm or less to the total of the Fe-based alloy particles is from 0% by volume to 7% by volume.

<5> The crystalline Fe-based alloy powder according to any one of <1> to <4>, wherein:

d50 is more than 5.0 μm and less than or equal to 35.0 μm; and a ratio of Fe-based alloy particles having a particle diameter of 5 μm or less to the total of the Fe-based alloy particles, which is determined by laser diffractometry, is from 0% by volume to 8% by volume.

<6> The crystalline Fe-based alloy powder according to <5>, wherein the ratio of Fe-based alloy particles having a particle diameter of 5 μm or less to the total of the Fe-based alloy particles is from 0% by volume to 5% by volume.

<7> The crystalline Fe-based alloy powder according to any one of <1> to <6>, wherein the composition of the Fe-based alloy particles includes Cu, Si, and B, and at least one of Nb or Mo, with the remainder including Fe and impurities.

<8> The crystalline Fe-based alloy powder according to <7>, wherein the composition of the Fe-based alloy particles is such that, in a case in which a total content of Cu, Si, B, Nb, Mo, Cr, and Fe is 100 atom %, a content of Cu is from 0.1 atom % to 3.0 atom %, a content of Si is from 13.0 atom % to 16.0 atom %, a content of B is 7.0 atom % or more and less than 12.0 atom %, a total content of Nb and Mo is more than 0 atom % and less than or equal to 6.0 atom %, and a content of Cr is from 0 atom % to 5.0 atom %.

<9> The crystalline Fe-based alloy powder according to <8>, wherein a content of Mo is more than 0 atom % and less than 4.0 atom %.

<10> The crystalline Fe-based alloy powder according to any one of <1> to <9>, wherein the shape of the Fe-based alloy particles is a shape surrounded by a curved surface.

<11> The crystalline Fe-based alloy powder according to any one of <1> to <10>, wherein the Fe-based alloy particles include an oxide film at the surface layer part.

<12> A method for producing a crystalline Fe-based alloy powder, the method being a method for producing the crystalline Fe-based alloy powder according to any one of <1> to <11>, wherein the method includes:

a process of obtaining an amorphous Fe-based alloy powder composed of amorphous Fe-based alloy particles by an atomization method; and a process of performing classification and heat treatment in this order or performing heat treatment and classification in this order, with respect to the amorphous Fe-based alloy powder, thereby obtaining the crystalline Fe-based alloy powder.

<13> The method for producing a crystalline Fe-based alloy powder according to <12>, wherein the classification includes a first classification, which is performed using a sieve, and a second classification, which is performed using a centrifugal air flow type classifier, after the first classification.

Advantageous Effects of Invention

According to one aspect of the present disclosure, a crystalline Fe-based alloy powder having a reduced coercive force may be provided.

According to another aspect of the present disclosure, a method of producing a crystalline Fe-based alloy powder, the method being capable of producing a crystalline Fe-based alloy powder having a reduced coercive force, may be provided.

DESCRIPTION OF EMBODIMENTS

Figure 1:
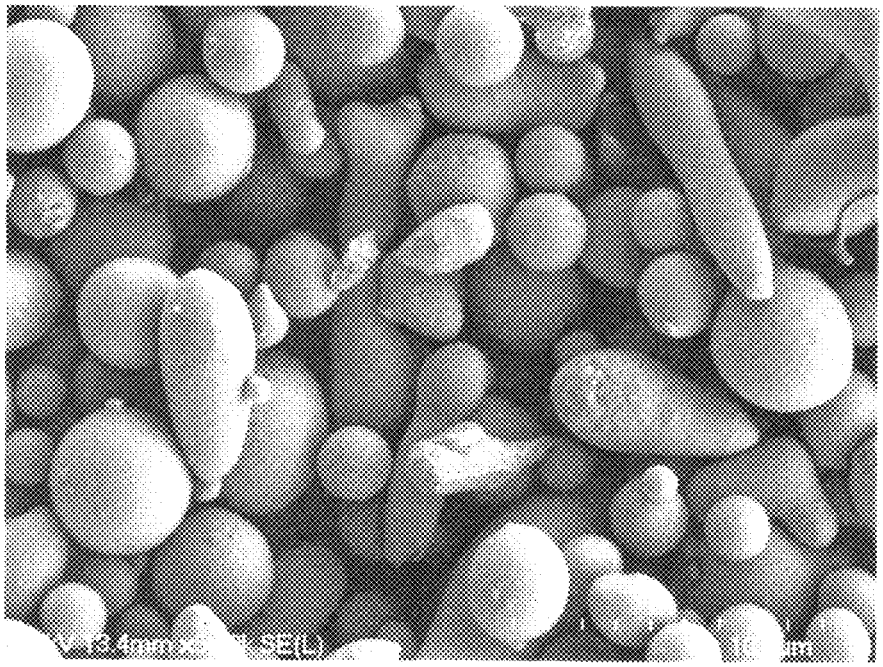
FIG. 1 is a SEM photograph of Sample No. 25 after heat treatment (crystalline Fe-based alloy powder), which is taken at a magnification of 5,000×, in the Examples of the present disclosure.

In this specification, a numerical range described by using "to" means a range including numerical values described in front of and behind "to", as the minimum value and the maximum value.

In this specification, the term "process" includes not only an independent process, but also a case which cannot be clearly distinguished from other process, as long as the predetermined purpose of the process is achieved.

Crystalline Fe-Based Alloy Powder

The crystalline Fe-based alloy powder of the disclosure is composed of Fe-based alloy particles containing, within the structure, nanocrystal grains having an average grain size of 30 nm or less. Further, in a cumulative distribution curve, which is obtained by laser diffractometry and shows the relationship between the particle diameter and the cumulative frequency from the small particle diameter side, d50 that is a particle diameter corresponding to a cumulative frequency of 50% by volume is from 3.5 μm to 35.0 μm. Further, the ratio of Fe-based alloy particles having a particle diameter of 2 μm or less to the total of the Fe-based alloy particles, which is determined by laser diffractometry, is from 0% by volume to 8% by volume.

In this specification, the "crystalline Fe-based alloy powder" means a Fe-based alloy powder including both a crystal phase and an amorphous phase. Herein, the concept of the "crystal phase" also encompasses the above nanocrystal grains having an average grain size of 30 nm or less.

Further, in this specification, the Fe-based alloy particles that constitute the crystalline Fe-based alloy powder may be referred to as "crystalline Fe-based alloy particles".

In the crystalline Fe-based alloy powder of the disclosure, the coercive force is reduced.

Accordingly, the powder of the disclosure has favorable soft magnetic properties.

The reason why the effect of coercive force reduction is exhibited is not clear, but is guessed as follows. However, the crystalline Fe-based alloy powder of the disclosure is by no means limited to the following reason.

As described above, the crystalline Fe-based alloy powder of the disclosure is composed of Fe-based alloy particles containing, within the structure, nanocrystal grains having an average grain size of 30 nm or less. These nanocrystal grains contribute to the improvement of magnetic properties of the whole Fe-based alloy particles (that is, the crystalline Fe-based alloy powder).

On the other hand, it is thought that a segregation region, where elements (for example, Si, B, or Cu) other than Fe are segregated, may be generated in the vicinity of the surface layer of the Fe-based alloy particle. Such a segregation region is substantially nonmagnetic, or is inferior in magnetism as compared with the Fe-based alloy. Therefore, the segregation region may be a factor deteriorating the magnetic properties of the Fe-based alloy particles (that is, the crystalline Fe-based alloy powder).

As compared with case of Fe-based alloy particles having a particle diameter of more than 2 μm, in the Fe-based alloy particles having a particle diameter of 2 μm or less, the volume proportion of the region where nanocrystal grains are present is small, and the volume proportion occupied by the segregation region is great. Accordingly, it is thought that the fact that the crystalline Fe-based alloy powder contains Fe-based alloy particles having a particle diameter of 2 μm or less may be a factor deteriorating the magnetic properties of the whole crystalline Fe-based alloy powder.

In the crystalline Fe-based alloy powder of the disclosure, the ratio of Fe-based alloy particles having a particle diameter of 2 μm or less to the total of the Fe-based alloy particles is reduced to be from 0% by volume to 8% by volume. Accordingly, it is thought that deterioration in magnetic properties caused by the Fe-based alloy particles having a particle diameter of 2 μm or less is suppressed and, as a result, the coercive force is reduced in the whole crystalline Fe-based alloy powder.

Conventionally, concerning the improvement of magnetic properties of a Fe-based alloy powder, there are cases in which Fe-based alloy particles having a great particle diameter are focused; however, there are few cases in which Fe-based alloy particles having a small particle diameter are focused.

The crystalline Fe-based alloy powder of the disclosure is found by focusing the Fe-based alloy particles having a small particle diameter (specifically, Fe-based alloy particles having a particle diameter of 2 μm or less).

As described above, in the crystalline Fe-based alloy powder of the disclosure, the coercive force is reduced.

In the crystalline Fe-based alloy powder of the disclosure, the coercive force at an applied magnetic field of 40 kA/m is preferably 190 A/m or less, more preferably 130 A/m or less, still more preferably 60 A/m or less, and still more preferably 40 A/m or less.

The lower limit of the coercive force at an applied magnetic field of 40 kA/m is not particularly limited. From the viewpoint of producing suitability of the crystalline Fe-based alloy powder of the disclosure, the lower limit may be 5 A/m or may be 10 A/m.

Here, the applied magnetic field of 40 kA/m corresponds to an applied magnetic field of 500 Oe.

Nanocrystal Grain

The crystalline Fe-based alloy powder of the disclosure is composed of Fe-based alloy particles containing, within the structure, nanocrystal grains having an average grain size of 30 nm or less.

The term "structure" used herein means the structure of the Fe-based alloy particle.

Since the nanocrystal grains have an average grain size of 30 nm or less, the effect of a reduction in coercive force of the crystalline Fe-based alloy powder is exhibited.

Meanwhile, the average grain size of the nanocrystal grains is preferably 5 nm or more. In a case in which the average grain size of the nanocrystal grains is 5 nm or more, the magnetic properties of the crystalline Fe-based alloy powder can be further improved.

In this specification, the expression "the crystalline Fe-based alloy powder is composed of Fe-based alloy particles containing, within the structure, nanocrystal grains having an average grain size of 30 nm or less" means that the average grain size of the nanocrystal grains, which is determined by the method described below, is 30 nm or less.

It is thought that the nanocrystal grain has a fine crystal structure and one nanocrystal grain is a single crystal. Accordingly, in this specification, the size of a crystallite is treated as the average grain size of the nanocrystal grains.

Specifically, first, the crystalline Fe-based alloy powder of the disclosure is compacted, to prepare a sample for X-ray diffraction, the sample having a flat plane. With regard to the flat plane of the prepared sample for X-ray diffraction, powder X-ray diffraction is performed, thereby obtaining an X-ray diffraction spectrum.

The powder X-ray diffraction is performed within a range of 2θ of from 20° to 60° on the conditions of 0.02 deg/step and 2 step/sec, using an X-ray diffraction apparatus equipped with a Cu—Kα ray source (for example, RINT2000 (trade name), manufactured by Rigaku Corporation).

Using the peak of bccFe-Si [diffraction plane (110)] in the obtained X-ray diffraction spectrum, the size D of the crystallite is determined according to the Scherrer's equation described below.

The obtained size D of the crystallite is taken as the average grain size of the nanocrystal grains.

$$D=(K\cdot\lambda)/(\beta\cos\theta)\text{Scherrer's equation}$$

[D represents the size of the crystallite; K represents the Scherrer constant, specifically, K is 0.9; λ represents the wavelength of X-ray; β represents the full width at half maximum of the peak of a diffraction plane (110); and θ represents the Bragg angle (Bragg angle: half of the diffraction angle 2θ).]

In the Examples described below, in all of the samples, the main peak which has the maximum diffraction intensity in the X-ray diffraction spectrum is around 2θ=45°, and is the peak of bccFe-Si [diffraction plane (110)].

Concerning the Fe-based alloy particle that constitutes the crystalline Fe-based alloy powder of the disclosure, the content percentage of the crystal phase in the structure is preferably 30% by volume or more. Here, the concept of the crystal phase encompasses the nanocrystal grains described above.

In a case in which the content percentage of the crystal phase in the structure of the Fe-based alloy particle is 30% by volume or more, the magnetostriction of the crystalline Fe-based alloy powder can be further reduced. The content percentage of the crystal phase in the structure of the Fe-based alloy particle is more preferably 50% by volume or more.

The upper limit of the content percentage of the crystal phase in the structure of the Fe-based alloy particle is not particularly limited. There are cases in which the magnetostriction is also affected by the balance between the crystal phase and the amorphous phase. Taking this point into consideration, the upper limit of the content percentage of the crystal phase in the alloy structure may be, for example, 95% by volume, or may be 90% by volume or less.

The nanocrystal grain preferably includes bccFe—Si.

The nanocrystal grain may further include a FeB-type compound.

The content percentage (CP) of the crystal phase in the structure of the Fe-based alloy particle can be calculated according to the following equation, based on the area (AA) of a broad diffraction pattern derived from the amorphous phase and the area (AC) of the main peak which has the maximum diffraction intensity derived from the crystal phase, in the X-ray diffraction spectrum obtained by the powder X-ray diffraction described above.

$$\text{Content Percentage (CP)(\% by volume)} = AC/(AC+AA)\times 100$$

d50

In the crystalline Fe-based alloy powder of the disclosure, d50 that is a particle diameter corresponding to a cumulative frequency of 50% by volume in a cumulative distribution curve, which is obtained by laser diffractometry and shows the relationship between the particle diameter and the cumulative frequency from the small particle diameter side, is from 3.5 μm to 35.0 μm.

When d50 is 3.5 μm or more, in a magnetic core (for example, a dust core, a metal composite core, or the like) produced by using the crystalline Fe-based alloy powder of the disclosure, the space factor of the Fe-based alloy particles can be enhanced, and as a result, the saturation magnetic flux density and magnetic permeability of the magnetic core can be enhanced. d50 of the crystalline Fe-based alloy powder is preferably more than 5.0 μm, and more preferably 8.0 μm or more.

When d50 is 35.0 μm or less, in a magnetic core produced by using the crystalline Fe-based alloy powder of the disclosure, the eddy current loss can be reduced. As a result, for example, in a case in which the above magnetic core is used on a high frequency condition of 500 kHz or more, the magnetic core loss can be reduced. d50 of the crystalline Fe-based alloy powder is preferably 28.0 μm or less, and more preferably 19.0 μm or less.

In this specification, d50 of the crystalline Fe-based alloy powder is a particle diameter corresponding to a cumulative frequency of 50% by volume in a cumulative distribution curve, which is obtained by laser diffractometry and shows the relationship between the particle diameter and the cumulative frequency from the small particle diameter side.

That is, d50 of the crystalline Fe-based alloy powder is a volume-based median diameter of the Fe-based alloy particles, which is determined by laser diffractometry.

Hereinafter, one example of the method for measuring d50 of the crystalline Fe-based alloy powder is shown.

With regard to the whole of the crystalline Fe-based alloy powder of the disclosure, a cumulative distribution curve, that indicates the relationship between the particle diameter (μm) and the cumulative frequency (% by volume) from the small particle diameter side, is obtained by laser diffractometry. As the apparatus, for example, a laser diffraction/scattering particle size distribution measuring device (for example, LA-920 (trade name), manufactured by HORIBA Ltd.) is used.

In the cumulative distribution curve thus obtained, the particle diameter corresponding to the cumulative frequency of 50% by volume is read, and this particle diameter is taken as d50 of the crystalline Fe-based alloy powder.

(d90−d10)/d50

In the crystalline Fe-based alloy powder of the disclosure, in a case in which a particle size corresponding to a cumulative frequency of 10% by volume in the cumulative distribution curve described above is taken as d10 and a particle size corresponding to a cumulative frequency of 90% by volume is taken as d90, it is preferable that (d90−d10)/d50 is from 1.00 to 4.00.

A smaller numerical value of (d90−d10)/d50 means that the variation in particle diameter is small.

In a case in which (d90−d10)/d50 is 1.00 or more, in a magnetic core (for example, a dust core, a metal composite core, or the like) produced by using the crystalline Fe-based alloy powder, the space factor of the Fe-based alloy particles is more enhanced.

In a case in which (d90−d10)/d50 is 4.00 or less, the proportion of particles having a relatively large particle diameter in the crystalline Fe-based alloy powder is reduced and, as a result, a desired magnetic property is obtained easily. In this regard, in detail, in the amorphous Fe-based alloy particles before heat treatment, which is described below, a coarse crystal phase is easily formed in the structure of a particle having a relatively large particle diameter. Even if such a particle is subjected to heat treatment, it is hard to obtain a crystal phase of nanocrystal grains in the structure, and there are cases in which a desired magnetic property cannot be obtained. In this regard, in a case in which (d90−d10)/d50 is 4.00 or less, the proportion of particles having a relatively large particle diameter in the crystalline Fe-based alloy powder is reduced, and thus, a desired magnetic property is obtained easily.

Here, the meaning of d50 is as described above.

d10 means a particle diameter corresponding to a cumulative frequency of 10% by volume in the cumulative distribution curve, which is obtained by laser diffractometry and shows the relationship between the particle diameter and the cumulative frequency from the small particle diameter side.

d90 means a particle diameter corresponding to a cumulative frequency of 90% by volume in the cumulative distribution curve described above.

One example of the method for measuring d10 and d90 is substantially similar to the example of the method for measuring d50, except that the particle diameter corresponding to the cumulative frequency of 10% by volume and the particle diameter corresponding to the cumulative frequency of 90% by volume are read, respectively.

Ratio of Fe-based Alloy Particles Having Particle Diameter of 2 μm or Less

In the crystalline Fe-based alloy powder of the disclosure, the ratio of Fe-based alloy particles having a particle diameter of 2 μm or less to the total of the Fe-based alloy particles (hereinafter, also referred to as, simply, "the ratio of Fe-based alloy particles having a particle diameter of 2 μm or less"), which is determined by laser diffractometry, is from 0% by volume to 8% by volume.

Thereby, the coercive force of the crystalline Fe-based alloy powder is reduced.

The ratio of Fe-based alloy particles having a particle diameter of 2 μm or less is preferably from 0% by volume to 7% by volume.

Thereby, the coercive force of the crystalline Fe-based alloy powder is further reduced. Accordingly, for example, it is easy to achieve a coercive force of 130 A/m or less at an applied magnetic field of 40 kA/m.

In this specification, the ratio (% by volume) of Fe-based alloy particles having a particle diameter of 2 μm or less to the total of the Fe-based alloy particles means a value determined by laser diffractometry.

Hereinafter, one example of the method for measuring the ratio (% by volume) of Fe-based alloy particles having a particle diameter of 2 μm or less by laser diffractometry is shown.

With regard to the whole of the crystalline Fe-based alloy powder of the disclosure, a cumulative distribution curve is obtained by a method similar to the example of the method for measuring d50.

In the cumulative distribution curve thus obtained, the cumulative frequency corresponding to the particle diameter of 2 μm is read, and this cumulative frequency is designated as the ratio of Fe-based alloy particles having a particle diameter of 2 μm or less to the total of the Fe-based alloy particles.

Ratio of Fe-based Alloy Particles Having Particle Diameter of 5 μm or Less

In the crystalline Fe-based alloy powder of the disclosure, the ratio of Fe-based alloy particles having a particle diameter of 5 μm or less to the total of the Fe-based alloy particles (hereinafter, also referred to as, simply, "the ratio of Fe-based alloy particles having a particle diameter of 5 μm or less"), which is determined by laser diffractometry, is preferably from 0% by volume to 8% by volume, and more preferably from 0% by volume to 5% by volume. Thereby, the coercive force of the crystalline Fe-based alloy powder is further reduced.

In this specification, the ratio (% by volume) of Fe-based alloy particles having a particle diameter of 5 μm or less to the total of the Fe-based alloy particles means a value determined by laser diffractometry.

One example of the method for measuring the ratio (% by volume) of Fe-based alloy particles having a particle diameter of 5 μm or less by laser diffractometry is substantially similar to the above-described example of the method for measuring the ratio (% by volume) of Fe-based alloy particles having a particle diameter of 2 μm or less by laser diffractometry, except that the cumulative frequency corresponding to the particle diameter of 5 μm is read in the cumulative distribution curve.

In the crystalline Fe-based alloy powder of the disclosure, a preferable example of a combination of d50 and the ratio of Fe-based alloy particles having a particle diameter of 5 μm or less is a combination in which d50 is more than 5.0 μm but 35.0 μm or less, and the ratio of Fe-based alloy particles having a particle diameter of 5 μm or less is from 0% by volume to 8% by volume.

With this combination, the coercive force of the crystalline Fe-based alloy powder can be further reduced. Accordingly, for example, it is easy to achieve a coercive force of 60 A/m or less at an applied magnetic field of 40 kA/m.

In the above combination, the ratio of Fe-based alloy particles having a particle diameter of 5 μm or less is more preferably from 0% by volume to 5% by volume. In this case, the coercive force of the crystalline Fe-based alloy powder can be further reduced, and thus, for example, it is easy to achieve a coercive force of 40 A/m or less at an applied magnetic field of 40 kA/m.

Fe-Based Alloy

In this specification, the "Fe-based alloy" means an alloy containing Fe (iron) as a main component.

Here, the main component indicates a component having a highest content percentage (% by mass).

The content percentage of Fe in the Fe-based alloy is preferably 50% by mass or more.

The composition of the Fe-based alloy preferably contains Cu (copper), Si (silicon), B (boron), and at least one of Nb (niobium) or Mo (molybdenum), with the remainder containing Fe and impurities.

Such a preferable composition may further contain Cr (chromium) and the like.

More preferably, the composition of the Fe-based alloy is such that, when a total content of Cu, Si, B, Nb, Mo, Cr, and Fe is 100 atom %, a content of Cu is from 0.1 atom % to 3.0 atom %, a content of Si is from 13.0 atom % to 16.0 atom %, a content of B is 7.0 atom % or more but less than 12.0 atom %, a total content of Nb and Mo is more than 0 atom % but 6.0 atom % or less, and a content of Cr is from 0 atom % to 5.0 atom %.

In a case in which the composition of the Fe-based alloy is the above composition, in the crystalline Fe-based alloy particles, the coercive force can be further reduced, the saturation magnetization can be enhanced (for example, the saturation magnetization can be made 110 emu/g or more), and the magnetostriction constant can be further reduced.

Hereinafter, each element, which may be included in the composition of the Fe-based alloy, and preferable contents of these elements are described.

The preferable content (atom %) of each element shown below is atom %, when the total content of Cu, Si, B, Nb, Mo, Cr, and Fe is taken as 100 atom %.

Cu is an element that contributes to the formation of fine (specifically, with an average grain size of 30 nm or less) nanocrystal grains.

The content of Cu is preferably from 0.1 atom % to 3.0 atom %.

When the content of Cu is 0.1 atom % or more, the effect described above is more effectively exhibited.

When the content of Cu is 3.0 atom % or less, the saturation magnetic flux density of the particles that constitute the powder is further increased, and embrittlement of the particles that constitute the powder is suppressed.

The content of Cu is preferably 1.5 atom % or less, and more preferably 1.2 atom % or less.

When the content of Cu is 1.5 atom % or less, in the case of obtaining a crystalline Fe-based alloy powder by using an amorphous Fe-based alloy powder as a raw material of the crystalline Fe-based alloy powder and by nano-crystallizing a part of the structure of the particle that constitutes the amorphous Fe-based alloy powder, the proportion of a crystal phase in the amorphous Fe-based alloy which is a raw material is easily reduced. Thereby, more favorable soft magnetic properties are obtained in the crystalline Fe-based alloy powder.

Si has an effect of promoting amorphization of the Fe-based alloy. Moreover, Si solid-dissolves in Fe, and Si is an element that contributes to the reduction in magnetostriction and magnetic anisotropy.

The content of Si is preferably from 13.0 atom % to 16.0 atom %.

When the content of Si is from 13.0 atom % to 16.0 atom %, in the case of using an amorphous Fe-based alloy powder as the raw material, an amorphous Fe-based alloy powder is easily produced by, for example, an atomization method described below. As a result, more favorable soft magnetic properties are obtained in the crystalline Fe-based alloy powder.

B has an effect of promoting amorphization of the Fe-based alloy.

The content of B is preferably 7.0 atom % or more but less than 12.0 atom %.

When the content of B is 7.0 atom % or more, in the case of using an amorphous Fe-based alloy powder as the raw material, an amorphous Fe-based alloy powder is easily produced by, for example, an atomization method described below. As a result, more favorable soft magnetic properties are obtained in the crystalline Fe-based alloy powder.

When the content of B is less than 12.0 atom %, a higher content of Fe that is a magnetic element is ensured and, as a result, the saturation magnetization in the crystalline Fe-based alloy powder is further improved.

The total content of Nb and Mo is preferably more than 0 atom % but 6.0 atom % or less.

When the total content of Nb and Mo is 6.0 atom % or less, the saturation magnetization in the crystalline Fe-based alloy powder is further improved. From the viewpoint of such an effect, the total content of Nb and Mo is more preferably less than 4.0 atom %, and still more preferably 3.5 atom % or less.

When the total content of Nb and Mo is more than 0 atom %, it is advantageous in terms of amorphization of the Fe-based alloy and improvement in uniformity of the grain size of the nanocrystal grains (and further, as a result of which, reduction in magnetostriction and magnetic anisotropy). From the viewpoints of such effects, the total content of Nb and Mo is more preferably 0.1 atom % or more, and still more preferably 0.5 atom % or more.

In particular, when the content of Mo is more than 0 atom %, it is advantageous in terms of amorphization of the Fe-based alloy. From the viewpoint of such an effect, the content of Mo is preferably more than 0 atom %, more preferably 0.1 atom % or more, and still more preferably 0.5 atom % or more. Further, the content of Mo is preferably less than 4.0 atom %, and more preferably 3.5 atom % or less.

The content of Cr is preferably from 0 atom % to 5.0 atom %.

When the content of Cr is 5.0 atom % or less, the saturation magnetization in the crystalline Fe-based alloy powder is further improved.

The content of Cr may be 0 atom % or may be more than 0 atom %.

When the content of Cr is more than 0 atom %, it is advantageous in terms of improvement in corrosion resistance of the crystalline Fe-based alloy powder and reduction in coercive force of the crystalline Fe-based alloy powder.

Fe is a main component of the Fe-based alloy and is an element that exerts influence on magnetic properties such as saturation magnetization.

The content (atom %) of Fe is defined according to the balance with the contents of other elements. From the viewpoint of further improving the saturation magnetization of the crystalline Fe-based alloy powder, the content (atom %) of Fe is preferably 70 atom % or more.

Further, in the case of obtaining a crystalline Fe-based alloy powder by using an amorphous Fe-based alloy powder as a raw material of the crystalline Fe-based alloy powder and by nano-crystallizing a part of the structure of the particle that constitutes the amorphous Fe-based alloy powder, the content of Fe is preferably less than 79.9 atom %. When the content of Fe is less than 79.9 atom %, in the amorphous Fe-based alloy powder as the raw material, the proportion of the crystal phase in the amorphous Fe-based alloy can be further reduced. Accordingly, more favorable soft magnetic properties are obtained in the crystalline Fe-based alloy powder.

The composition of the Fe-based alloy may include C (carbon) in place of a part of B and/or Si.

The composition of the Fe-based alloy may include P (phosphorus) in place of a part of B.

The composition of the Fe-based alloy may include impurities.

Examples of the impurities include S (sulfur), O (oxygen), N (nitrogen), and the like.

The content of S is preferably 200 ppm by mass or less.

The content of O is preferably 5,000 ppm by mass or less.

The content of N is preferably 1,000 ppm by mass or less.

Shape of Fe-Based Alloy Particle

The shape of the Fe-based alloy particle is preferably a shape surrounded by a curved surface.

The shape of a particle being a shape surrounded by a curved surface means that the particle is a particle formed by an atomization method.

In contrast, the shape of a particle, which is formed by pulverizing and finishing a Fe-based alloy in the form of a ribbon (a thin strip), does not become a "shape surrounded by a curved surface".

Examples of the shape surrounded by a curved surface include a spherical shape, an approximately spherical shape, a teardrop-like shape, a gourd-like shape, and the like.

It is preferable that the particles composed of the Fe-based alloy include a particle having a spherical shape or an approximately spherical shape.

In a case in which the shape of the Fe-based alloy particle is a shape surrounded by a curved surface (in other words, in a case in which the particle composed of the Fe-based alloy is a particle formed by an atomization method), the effect due to the powder of the disclosure is further effectively exhibited.

Preferable mode of the atomization method is described below.

Oxide Film

The Fe-based alloy particle may contain an oxide film at the surface layer part.

In a case in which the Fe-based alloy particle includes an oxide film at the surface layer part, the effect of coercive force reduction is further effectively exhibited. The reason for this is thought as follows.

The oxide film is substantially nonmagnetic, or is inferior in magnetism as compared with the Fe-based alloy.

As compared with the case of Fe-based alloy particles having a particle diameter of more than 2 μm, in the Fe-based alloy particles having a particle diameter of 2 μm or less, the volume proportion occupied by the oxide film is great. Therefore, in the mode in which the Fe-based alloy particle contains an oxide film at the surface layer part, deterioration in magnetic properties due to the Fe-based alloy particles having a particle diameter of 2 μm or less (that is, the Fe-based alloy particles containing an oxide film at the surface layer part) becomes more significant.

Accordingly, it is thought that, in the mode in which the Fe-based alloy particle contains an oxide film at the surface layer part, since the ratio of Fe-based alloy particles having a particle diameter of 2 μm or less (that is, Fe-based alloy particles containing an oxide film at the surface layer part)

is from 0% by volume to 8% by volume, the range of reduction (that is, the range of upgrade) in coercive force becomes larger.

In a case in which the composition of the Fe-based alloy contains Cu, Si, B, and at least one of Nb or Mo, with the remainder containing Fe and impurities, it is preferable that the oxide film includes Fe, Si, Cu, and B.

The thickness of the oxide film is preferably 2 nm or more.

In a case in which the thickness of the oxide film is 2 nm or more, since the ratio of Fe-based alloy particles having a particle diameter of 2 μm or less (that is, Fe-based alloy particles containing an oxide film at the surface layer part) is from 0% by volume to 8% by volume, the range of reduction (that is, the range of upgrade) in coercive force becomes larger.

In a case in which the thickness of the oxide film is 2 nm or more, it is advantageous from the viewpoints of improvement in rust resistance of the Fe-based alloy particle, improvement in insulating property between the Fe-based alloy particles, suppression of oxidization of the Fe-based alloy particle, and the like.

There is no particular limitation as to the upper limit of the thickness of the oxide film. From the viewpoint of moldability in the case of producing a magnetic core using the crystalline Fe-based alloy powder of the disclosure, the upper limit of the thickness of the oxide film is, for example, 50 nm.

Preferred Application

The crystalline Fe-based alloy powder of the disclosure, which is described above, is particularly preferable as the material for a magnetic core.

Examples of the magnetic core include a dust core, a metal composite core, and the like.

The magnetic core, which is obtained by using the crystalline Fe-based alloy powder of the disclosure, is preferably used in inductors, noise filters, choke coils, transformers, reactors, and the like.

In the case of using the crystalline Fe-based alloy powder of the disclosure as the material for a dust core, for example, the crystalline Fe-based alloy powder of the disclosure is mixed with a binder and used.

Examples of the binder include, but are not limited to, an epoxy resin, an unsaturated polyester resin, a phenol resin, a xylene resin, a diallyl phthalate resin, a silicone resin, polyamidoimide, polyimide, water glass and the like.

For example, a dust core can be produced according to the following method.

A mixture of the crystalline Fe-based alloy powder of the disclosure and the binder is packed into a metal mold for molding, and pressed at a molding pressure of from about 1 GPa to about 2 GPa using a hydraulic press molding apparatus or the like, to obtain a molded body. The mixture may further contain a lubricant such as zinc stearate.

The molded body thus obtained is heat treated, for example, at a temperature of 200° C. or higher but lower than the crystallization temperature, for about one hour, thereby removing the mold distortion as well as curing the binder, to obtain a dust core.

In this case, the heat treatment atmosphere may be an inert atmosphere or an oxidizing atmosphere.

The shape of the dust core to be obtained is not particularly limited and may be selected as appropriate according to the purpose.

Examples of the shape of the dust core include a ring shape (for example, an annular shape, a rectangular frame shape, or the like), a rod shape, and the like.

In the mixture of the crystalline Fe-based alloy powder of the disclosure and the binder, the content of the binder is preferably from 1% by mass to 5% by mass, with respect to the total amount of the crystalline Fe-based alloy powder of the disclosure and the binder.

Within this range, the functions of a binder (for example, a function as a binding material that binds the Fe-based alloy particles together, a function of insulation between Fe-based alloy particles, a function of holding the strength, and the like) are more effectively exhibited.

A metal composite core can be produced by, for example, embedding a coil in a mixture of the crystalline Fe-based alloy powder of the disclosure and a binder, and then performing integral molding.

In a case in which a thermoplastic resin or a thermosetting resin is selected as the binder, a metal composite core in which a coil is sealed can be easily produced according to a known molding means such as injection molding.

In addition, in the case of using the crystalline Fe-based alloy powder of the disclosure as the material for a magnetic core, the crystalline Fe-based alloy powder of the disclosure may be used singly or may be mixed with an additional metal powder and used.

Examples of the additional metal powder include soft magnetic powders. Specific examples thereof include an amorphous Fe-based alloy powder, a pure Fe powder, a Fe—Si alloy powder, a Fe—Si—Cr alloy powder, and the like.

d50 of the additional metal powder may be smaller or larger than, or equivalent to d50 of the crystalline Fe-based alloy powder of the disclosure, and can be selected as appropriate according to the purpose.

Method for Producing Crystalline Fe-based Alloy Powder (Production Method A)

Hereinafter, one example (hereinafter, referred to as "production method A") of the production method for producing the crystalline Fe-based alloy powder of the disclosure is described.

Production method A is a method of producing the above-described crystalline Fe-based alloy powder of the disclosure, and includes:

a process of obtaining an amorphous Fe-based alloy powder composed of amorphous Fe-based alloy particles by an atomization method; and a process of obtaining the above crystalline Fe-based alloy powder by performing classification and heat treatment in this order or performing heat treatment and classification in this order, with respect to the amorphous Fe-based alloy powder.

The production method A may include other process, if necessary.

Process of Obtaining Amorphous Fe-based Alloy Powder

The production method A includes a process of obtaining an amorphous Fe-based alloy powder composed of amorphous Fe-based alloy particles by an atomization method.

The atomization method is a method including pulverizing a molten Fe-based alloy (hereinafter, also referred to as a "molten raw material"), which is the raw material of the amorphous Fe-based alloy powder, into powder, and then cooling the obtained powdery molten Fe-based alloy, thereby obtaining an amorphous Fe-based alloy powder composed of amorphous Fe-based alloy particles.

According to the atomization method, it is easy to form an amorphous Fe-based alloy particle containing an oxide film at the surface layer part. The amorphous Fe-based alloy particle containing an oxide film at the surface layer part is made into a crystalline Fe-based alloy particle containing an oxide film at the surface layer part, through the process of obtaining a crystalline Fe-based alloy powder (that is, classification and heat treatment).

Thus, according to the production method A, it is easy to produce a crystalline Fe-based alloy powder (that is, a crystalline Fe-based alloy powder in which the effect of coercive force reduction is more effectively exhibited) composed of crystalline Fe-based alloy particles in the mode of containing an oxide film at the surface layer part, which is described above.

Further, according to the atomization method, an amorphous Fe-based alloy particle having a shape (for example, a spherical shape, an approximately spherical shape, a teardrop-like shape, a gourd-like shape, or the like) surrounded by a curved surface is obtained. The amorphous Fe-based alloy particle having a shape surrounded by a curved surface is made into a crystalline Fe-based alloy particle in the mode of having a shape surrounded by a curved surface, which is described above, through the process of obtaining a crystalline Fe-based alloy powder (that is, classification and heat treatment).

The atomization method is not particularly limited, and a known method such as a gas atomization method, a water atomization method, a disk atomization method, a high speed rotating water flow atomization method, or a high speed combustion flame atomization method can be applied.

As the atomization method, an atomization method, which is excellent in the performance of pulverizing the molten raw material and is capable of cooling at a rate of $10^{3}$° C./sec or higher (more preferably $10^{5}$° C./sec or higher), is preferable in terms of easily obtaining the amorphous Fe-based alloy.

A water atomization method is a method including jetting a high pressure water through a nozzle to let a flowing-down molten raw material splash and making the molten raw material into powder, and moreover, cooling the powdery molten raw material by using this high pressure water, thereby obtaining an amorphous Fe-based alloy powder (hereinafter, also referred to as, simply, "powder").

A gas atomization method is a method including jetting an inert gas through a nozzle to make a molten raw material into powder, and then cooling the molten raw material that has been made into powder, thereby obtaining a powder. Concerning the cooling in the gas atomization method, cooling using a high pressure water, cooling using a water tank placed at the lower part of the atomization device, cooling by dropping into running water, and the like can be exemplified.

A high speed rotating water flow atomization method is a method including, using a cooling vessel whose inner peripheral surface is a cylindrical surface, letting a cooling liquid flow down while circling along the inner peripheral surface, thereby forming a cooling liquid layer in a layered form, and then dropping a molten raw material to the cooling liquid layer to perform powdering and cooling, thereby obtaining a powder.

A high speed combustion flame atomization method is a method including jetting a flame as a flame jet at a supersonic speed or at a speed close to a sonic speed using a high speed combustor to make a molten raw material into powder, and then cooling the molten raw material that has been made into powder, by using a rapid cooling system employing water or the like as the cooling medium, thereby obtaining a powder. With regard to the high speed combustion flame atomization method, for example, description in JP-A No. 2014-136807 may be referred to.

As the atomization method, a disk atomization method, a high speed rotating water flow atomization method, or a high speed combustion flame atomization method is preferable in terms of exhibiting excellent cooling efficiency and being capable of obtaining an amorphous Fe-based alloy relatively easily.

Further, in the case of applying a water atomization method or a gas atomization method, it is preferable to use a high pressure water of higher than 50 MPa.

The amorphous Fe-based alloy particle (that is, the amorphous Fe-based alloy powder), which is obtained in this process, may contain a crystal phase in addition to an amorphous phase.

In the process of obtaining a crystalline Fe-based alloy powder (that is, classification and heat treatment), the content percentage of the crystal phase in the amorphous Fe-based alloy particle is preferably 2% by volume or less, more preferably 1% by volume or less, and particularly preferably substantially 0% by volume, from the viewpoint of obtaining a crystalline Fe-based alloy powder having more excellent magnetic properties.

The method for measuring the content percentage of the crystal phase in the amorphous Fe-based alloy particle is similar to the above-described method for measuring the content percentage of the crystal phase in the structure of the crystalline Fe-based alloy particle.

Each of a preferable mode of the composition of the amorphous Fe-based alloy, that constitutes the amorphous Fe-based alloy particle, and a preferable mode of the composition of the molten raw material is similar to the above-described preferable mode of the composition of the Fe-based alloy that constitutes the crystalline Fe-based alloy particle.

Note that, the operation in each process in the production method A exerts little influence on the composition of the Fe-based alloy.

Accordingly, it can be considered that the composition of the Fe-based alloy that constitutes the crystalline Fe-based alloy particle (that is, the crystalline Fe-based alloy powder) obtained by the production method A is substantially the same as the composition of the molten raw material and the composition of the amorphous Fe-based alloy.

Process of Obtaining Crystalline Fe-Based Alloy Powder

The production method A includes a process of obtaining a crystalline Fe-based alloy powder by performing classification and heat treatment in this order, or performing heat treatment and classification in this order, with respect to the amorphous Fe-based alloy powder.

In this process, through the heat treatment, the above-described nanocrystal grains having an average grain size of 30 nm or less are formed in the structure of the amorphous Fe-based alloy particle that constitutes the amorphous Fe-based alloy powder, thereby obtaining a crystalline Fe-based alloy powder.

Further, in this process, through the classification, a crystalline Fe-based alloy powder, which has d50 within the above-described range and the ratio of Fe-based alloy particles having a particle diameter of 2 μm or less within the above-described range, is obtained.

In this process, classification may be performed before heat treatment or after heat treatment. In a case in which classification is performed before heat treatment, classification may be performed again after the heat treatment (that is, classification, heat treatment, and classification may be performed in this order).

From the viewpoint of more efficiently obtaining a crystalline Fe-based alloy powder, which has d50 within the above-described range and has the ratio of Fe-based alloy particles having a particle diameter of 2 μm or less within the above-described range, it is preferable that classification is performed before heat treatment. That is, a preferable mode of this process is a mode of performing classification and heat treatment in this order, with respect to the amorphous Fe-based alloy powder.

Note that, the heat treatment exerts little influence on d50 and the ratio of Fe-based alloy particles having a particle diameter of 2 μm or less.

Accordingly, it can be considered that, in the mode of performing classification and heat treatment in this order with respect to the amorphous Fe-based alloy powder, d50 and the ratio of Fe-based alloy particles having a particle diameter of 2 μm or less in the crystalline Fe-based alloy powder, that is the powder after heat treatment, are the same as d50 and the ratio of Fe-based alloy particles having a particle diameter of 2 μm or less in the powder after classification but before heat treatment (amorphous Fe-based alloy powder), respectively. The same applies to the ratio of Fe-based alloy particles having a particle diameter of 5 μm or less.

Classification

The classification conditions are adjusted as appropriate so that, in the particles after classification, each of d50 and the ratio of particles having a particle diameter of 2 μm or less falls within the range described above.

Here, in the case of performing classification and heat treatment in this order, the "particles after classification" means an amorphous Fe-based alloy particles; and, in the case of performing heat treatment and classification in this order, the "particles after classification" means crystalline Fe-based alloy particles (hereinafter the same applies).

Examples of the classification method include a method which is performed using a sieve, a method which is performed using a classifying device, a combined method of these, and the like.

Examples of the classifying device include known classifying devices such as a centrifugal air flow type classifier or an electromagnetic sieve shaker.

In a centrifugal air flow type classifier, for example, d50, the ratio of particles having a particle diameter of 2 μm or less, and the like are adjusted by adjusting the number of revolutions of the classifying rotor and the air quantity.

In an electromagnetic sieve shaker, for example, d50, the ratio of particles having a particle diameter of 2 μm or less, and the like are adjusted by appropriately selecting the mesh of the sieve.

In the classification of a powder using a centrifugal air flow type classifier, the powder to be classified receives a centrifugal force due to the vortex flow formed by the classifying rotor that rotates at a high speed and a resistance force of the air flow supplied from the exterior blower. Accordingly, the above powder is divided into a group of large particles on which the centrifugal force acts greatly and a group of small particles on which the resistance force acts greatly.

The centrifugal force can be adjusted by changing the number of revolutions of the classifying rotor, and the resistance force can be easily adjusted by changing the air quantity from the blower. By adjusting the balance between the centrifugal force and the resistance force, the above powder can be classified into prescribed particle sizes.

In a case in which the group of small particles is collected, a group of large particles is removed from the powder. Hereinafter, the classification in this mode is also referred to as "overcut".

In a case in which the group of large particles is collected, a group of small particles is removed from the powder. Hereinafter, the classification in this mode is also referred to as "undercut".

It is preferred that the classification includes a first classification, which is performed using a sieve, and a second classification, which is performed using a centrifugal air flow type classifier after the first classification.

The second classification in this mode preferably includes an overcut, more preferably includes both an overcut and an undercut, and still more preferably includes an operation of performing an overcut and an undercut in this order.

The opening of the sieve in the first classification can be selected as appropriate.

From the viewpoint of further reducing the time needed for the first classification, the opening is, for example, 90 μm or more, preferably 150 μm or more, and more preferably 212 μm or more.

The upper limit of the opening is, for example, 300 μm, and preferably 250 μm, from the viewpoint of further reducing the load to be applied on the device used in the second classification.

The term "opening" in this specification means a nominal opening defined in JIS Z8801-1.

In the second classification, the number of revolutions of the classifying rotor in the centrifugal air flow type classifier is, for example, 500 rpm (revolution per minute) or more, and preferably 1,000 rpm or more. The larger the number of revolutions, the larger the number of particles having a small diameter in the powder. Thus, although it depends on the performance of the centrifugal air flow type classifier, the upper limit of the number of revolutions of the classifying rotor is, for example, 5,000 rpm, preferably 4,000 rpm, and more preferably 3,000 rpm.

In the second classification, the supply speed of the powder to be supplied to the centrifugal air flow type classifier is, for example, 0.5 kg/h or higher, preferably 1 kg/h or higher, and more preferably 2 kg/h or higher. The upper limit of the supply speed of the powder depends on the classification processing capacity of the centrifugal air flow type classifier.

In the second classification, the air quantity of the air flow in the centrifugal air flow type classifier is, for example, 0.5 $m^3/s$ or more, preferably 1.0 $m^3/s$ or more, and more preferably 2.0 $m^3/s$ or more. The upper limit of the air quantity of the air flow depends on the capacity of the blower in the centrifugal air flow type classifier.

Heat Treatment

The heat treatment conditions are appropriately adjusted so that the average grain size of the nanocrystal grains becomes 30 nm or less, in the crystalline Fe-based alloy particle obtained through the heat treatment.

The heat treatment can be conducted using a known heating furnace, for example, a batch-system electric furnace, a mesh belt-system continuous electric furnace, or the like.

Adjustment of the heat treatment condition is performed by adjusting, for example, the temperature elevating rate, the highest arrival temperature (holding temperature), the holding time at the highest arrival temperature, or the like.

The temperature elevating rate is, for example, from 1° C./h to 200° C./h, and preferably from 3° C./h to 100° C./h.

Although it depends on the crystallization temperature of the amorphous Fe-based alloy, the highest arrival temperature (holding temperature) is, for example, from 450° C. to 560° C., and preferably from 470° C. to 520° C.

The holding time at the highest arrival temperature is, for example, from 1 minute to 3 hours, and preferably from 30 minutes to 2 hours.

The crystallization temperature of the amorphous Fe-based alloy can be determined by performing thermal analysis within a temperature range of from room temperature (RT) to 600° C., and at a temperature elevating rate of 600° C./h, using a differential scanning calorimeter (DSC).

There is no particular limitation as to the atmosphere for performing the heat treatment.

Examples of the atmosphere for performing the heat treatment include an air atmosphere, an inert gas (nitrogen, argon, or the like) atmosphere, a vacuum atmosphere, and the like.

There is no particular limitation as to the method of cooling the crystalline Fe-based alloy powder obtained through the heat treatment.

Examples of the cooling method include furnace cooling, air cooling, and the like.

Further, cooling may be performed compulsory, by blowing an inert gas against the crystalline Fe-based alloy powder obtained through the heat treatment.

EXAMPLES

Hereinafter, Examples of the present disclosure are described; however, the disclosure is by no means limited to the following Examples.

Sample Nos. 1 to 20

Preparation of Ingot

Fe, Cu, Si, B, Nb, Mo, and Cr were weighed and placed in a crucible made of alumina. The crucible was placed in a vacuum chamber of a high frequency induction heating apparatus, and the inside of the vacuum chamber was vacuumed. Subsequently, under a decompression state, in an inert atmosphere (Ar), each of the raw materials was melted by high frequency induction heating, followed by cooling. In this way, ingots each having the alloy composition A to E described below were obtained.

The composition of each ingot was analyzed by ICP (inductive coupled plasma) optical emission spectrometry.

Alloy Composition

A: $Fe_{70.5}Cu_{1.0}Si_{13.5}B_{11.0}Nb_{3.0}Cr_{1.0}$
B: $Fe_{74.4}Cu_{1.0}Si_{13.5}B_{7.6}Nb_{2.5}Cr_{1.0}$
C: $Fe_{72.5}Cu_{1.0}Si_{13.5}B_{9.0}Mo_{3.0}Cr_{1.0}$
D: $Fe_{72.5}Cu_{1.0}Si_{13.5}B_{11.0}Mo_{1.0}Cr_{1.0}$
E: $Fe_{72.5}Cu_{1.0}Si_{13.5}B_{9.0}Nb_{3.0}Cr_{1.0}$

Note that, the operations in the processes after this process exert little influence on the composition of the Fe-based alloy.

Accordingly, it can be considered that the composition of the ingot is maintained as it is, also in the finally obtained crystalline Fe-based alloy powder.

Production of Amorphous Fe-Based Alloy Powder

The ingot was re-melted at a temperature of from 1,300° C. to 1,700° C., and the obtained molten alloy was powdered by a water atomization method, thereby obtaining an amorphous Fe-based alloy powder composed of amorphous Fe-based alloy particles.

In the water atomization method, the temperature of water as the atomizing medium was 20° C., and the injection pressure of the water was 100 MPa.

Classification

The amorphous Fe-based alloy powders (amorphous Fe-based alloy powders before classification) obtained as described above were each classified as follows, to obtain samples shown in Table 1.

In Table 1, a sample of a sample number (No.) with "*" indicates a comparative example, and a sample of a sample number (No.) without "*" indicates an example of the present invention.

Sample Nos. 1, *4, and 9 are samples which have only been subjected to the first classification described below.

Sample Nos. *2, *3, 5 to *8, and 10 to *20 are samples which have been subjected to the first classification described below and the second classification described below in this order.

Note that, Sample No. 10 and Nos. 14 to 17 are the same amorphous Fe-based alloy powder.

Classification Using Sieve (First Classification)

First, as the first classification common to all the samples, the amorphous Fe-based alloy powder before classification, which was obtained as described above, was passed through a sieve having an opening of 250 μm, whereby a group of coarse particles was removed from the amorphous Fe-based alloy powder.

The amorphous Fe-based alloy powder after the first classification and a resin were mixed, and the mixture thus obtained was cured. The cured product thus obtained was subjected to polishing and ion milling, to form a smooth surface. In the smooth surface thus obtained, the spot including an amorphous Fe-based alloy particle was observed with a transmission electron microscope (TEM) at a magnification of 500,000×, and moreover, composition mapping was performed.

As a result, it was confirmed that, in the amorphous Fe-based alloy particle in all of the samples, an oxide film having a thickness of from 2 nm to 30 nm was present at the surface layer part of the particle.

Further, identification of the oxide film was performed in accordance with Auger electron spectroscopy (JAMP-7830F (trade name), manufactured by JEOL Ltd.) and, as a result, it was revealed that the oxide film in all of the samples included Fe, Si, Cu, and B.

Classification Using Centrifugal Air Flow Type Classifier (Second Classification)

In Sample Nos. *2, *3, 5 to *8, and 10 to *20, a second classification was performed, using a centrifugal air flow type classifier (TC-15 (trade name), manufactured by Nissin Engineering Inc.), with respect to the amorphous Fe-based alloy powder after the first classification.

In detail, the air quantity of the blower, the number of revolutions of the classifying rotor, and the powder supply speed were adjusted as shown in Table 1, and the second classification in the mode of overcut was performed, whereby a group of large particles was removed from the amorphous Fe-based alloy powder after the first classification.

Various Measurements

With regard to each sample, d10, d50, d90, (d90−d10)/d50, the ratio (% by volume) of particles having a particle diameter of 2 μm or less, and the ratio (% by volume) of particles having a particle diameter of 5 μm or less were determined according to the methods described above.

Further, with regard to each sample, an X-ray diffraction spectrum was measured according to powder X-ray diffraction, on the conditions shown in the measurement method of the "content percent of the crystal phase in the structure of the particle", which is described above. In the X-ray diffraction spectrum, in a case in which a diffraction peak derived from a crystal phase is present, it is concluded that a crystal phase is "present", whereas in a case in which a diffraction peak derived from a crystal phase is not present, it is concluded that a crystal phase is "absent".

The results of the above measurements are shown in Table 1.

"RPS 5 μm" denotes "the ratio (% by volume) of particles having a particle diameter of 5 μm or less".

Further, each sample after classification (that is, the amorphous Fe-based alloy particles that had been classified) was observed at a magnification of from 100× to 5,000× using a scanning type microscope (SEM: Scanning Electron Microscope, S-4700 (trade name), manufactured by Hitachi, Ltd.).

As a result, in each sample, the shape of each particle was a shape surrounded by a curved surface. In detail, in all of the samples, a particle having a spherical shape, a particle having an approximately spherical shape, a particle having a teardrop-like shape, and a particle having a gourd-like shape were included.

Using a differential scanning calorimeter (DSC8270 (trade name), manufactured by Rigaku Corporation), the temperature of each sample after classification (that is, the amorphous Fe-based alloy particles that had been classified) was elevated at a rate of 10° C./min, to obtain a DSC curve.

From the DSC curve thus obtained, the crystallization temperature of each sample was determined.

The results are shown in Table 2.

Note that, the heat treatment described below exerts little influence on the particle size distribution of the particles.

Accordingly, it can be considered that the particle size distribution (in detail, d10, d50, d90, the ratio of particles having a particle diameter of 2 μm or less, and the ratio of particles having a particle diameter of 5 μm or less) in each sample after classification is maintained as it is, also in each sample after heat treatment.

TABLE 1

| | | Composition (atom %) | | | | | | | | Classification (overcut) | | | | | Particle size (μm) | | | (d90 − d10)/ |
|---|---|---|---|---|---|---|---|---|---|---|---|---|---|---|---|---|---|---|
| No. | | Fe | Cu | Si | B | Nb | Mo | Cr | CPFA | AQ ($m^3$/s) | NR (rpm) | SSP (kg/h) | RPS 2 μm | RPS 5 μm | d10 | d50 | d90 | d50 |
| 1 | A | 70.5 | 1.0 | 13.5 | 11.0 | 3.0 | 0.0 | 1.0 | absent | passed through a sieve opening of 250 μm | | | 0.97 | 7.55 | 5.7 | 17.7 | 42.5 | 2.07 |
| *2 | B | 74.4 | 1.0 | 13.5 | 7.6 | 2.5 | 0.0 | 1.0 | absent | 2.5 | 4000 | 3 | 13.53 | 84.83 | 1.8 | 3.3 | 5.6 | 1.15 |
| *3 | | | | | | | | | absent | 2.5 | 5000 | 3 | 21.51 | 86.86 | 1.5 | 2.9 | 5.5 | 1.37 |
| *4 | | | | | | | | | absent | passed through a sieve opening of 250 μm | | | 0.65 | 10.33 | 4.9 | 13.3 | 35.6 | 2.31 |
| 5 | C | 72.5 | 1.0 | 13.5 | 9.0 | 0.0 | 3.0 | 1.0 | absent | 2.5 | 2000 | 3 | 2.28 | 19.96 | 3.6 | 9.1 | 23.9 | 2.22 |
| 6 | | | | | | | | | absent | 2.5 | 3000 | 3 | 7.22 | 55.66 | 2.3 | 4.7 | 8.6 | 1.35 |
| *7 | | | | | | | | | absent | 2.5 | 4000 | 3 | 14.41 | 78.94 | 1.8 | 3.4 | 6.3 | 1.32 |
| *8 | D | 72.5 | 1.0 | 13.5 | 11.0 | 0.0 | 1.0 | 1.0 | absent | 2.5 | 1000 | 3 | 1.41 | 11.29 | 4.7 | 16.6 | 60.7 | 3.37 |
| 9 | | | | | | | | | absent | passed through a sieve opening of 250 μm | | | 2.01 | 12.14 | 4.5 | 16.9 | 65.4 | 3.61 |
| 10 | | | | | | | | | absent | 2.5 | 1000 | 3 | 1.41 | 11.29 | 4.7 | 16.6 | 60.7 | 3.37 |
| 11 | | | | | | | | | absent | 2.5 | 2000 | 3 | 3.01 | 21.67 | 3.4 | 8.9 | 21.0 | 1.99 |
| 12 | | | | | | | | | absent | 2.5 | 3000 | 3 | 7.35 | 52.91 | 2.3 | 4.8 | 10.6 | 1.75 |
| *13 | | | | | | | | | absent | 2.5 | 4000 | 3 | 18.85 | 81.78 | 1.6 | 3.2 | 6.1 | 1.44 |
| 14 | | | | | | | | | absent | 2.5 | 1000 | 3 | 1.41 | 11.29 | 4.7 | 16.6 | 60.7 | 3.37 |
| 15 | | | | | | | | | absent | 2.5 | 1000 | 3 | 1.41 | 11.29 | 4.7 | 16.6 | 60.7 | 3.37 |
| 16 | | | | | | | | | absent | 2.5 | 1000 | 3 | 1.41 | 11.29 | 4.7 | 16.6 | 60.7 | 3.37 |
| 17 | | | | | | | | | absent | 2.5 | 1000 | 3 | 1.41 | 11.29 | 4.7 | 16.6 | 60.7 | 3.37 |
| 18 | E | 72.5 | 1.0 | 13.5 | 9.0 | 3.0 | 0.0 | 1.0 | absent | 2.5 | 2000 | 3 | 1.44 | 18.00 | 3.9 | 9.3 | 21.9 | 1.94 |
| 19 | | | | | | | | | absent | 2.5 | 3000 | 3 | 4.92 | 45.58 | 2.6 | 5.3 | 12.7 | 1.91 |
| *20 | | | | | | | | | absent | 2.5 | 4000 | 3 | 12.81 | 82.68 | 1.8 | 3.4 | 5.8 | 1.16 |

In Table 1, the abbreviation "CPRA" denotes "presence or absence of the crystal phase in the Fe-based alloy", the abbreviation "AQ" denotes "air quantity of the blower", the abbreviation "NR" denotes "the number of revolutions of the classifying rotor", the abbreviation "SSP" denotes "the supply speed of the powder", the abbreviation "RPS 2 μm" denotes "the ratio (% by volume) of particles having a particle diameter of 2 μm or less", and the abbreviation

Heat Treatment

With respect to each sample (however, excluding Sample No. *8) after classification, a heat treatment on the conditions (the temperature elevating rate, the holding temperature KT, the holding time, the atmosphere, and the oxygen density) shown in Table 2 was performed, using an electric heat treatment furnace. 10 g of each sample (however, excluding Sample No. *8) were placed in a crucible made of alumina and this crucible was placed in the electric heat treatment furnace. In this state, the above heat treatment was conducted.

Here, the holding temperature KT means the highest arrival temperature in the heat treatment, and the holding time means the time during which the temperature is held at the highest arrival temperature (that is, the holding temperature KT).

The heat treatment under a $N_2$ atmosphere was conducted while introducing a $N_2$ gas into the electric heat treatment furnace.

The oxygen density means an oxygen density (% by volume) in the atmosphere of the heat treatment. The oxygen density was measured using an oxygen densitometer arranged inside the electric heat treatment furnace.

The oxygen density in the $N_2$ atmosphere was adjusted by adjusting the flow rate of the $N_2$ gas to be introduced into the electric heat treatment furnace.

After the heat treatment (in detail, after the holding time had passed), heating by the electric heat treatment furnace was stopped, and each sample (however, excluding Sample No. *8) was subjected to furnace cooling.

In this way, crystalline Fe-based alloy powders were obtained, as the samples after heat treatment.

With respect to Sample No. *8 after classification (that is, the amorphous Fe-based alloy powder), the above heat treatment was not conducted.

Measurement of Average Grain Size of Nanocrystal Grains

With regard to each of the samples (however, excluding Sample No. *8) after heat treatment, the average grain size (nm) of the nanocrystal grains incorporated in the structure of the particle was measured according to the method described above.

The results are shown in Table 2.

Further, with regard to each of the samples after heat treatment, the content percentage of the crystal phase in the structure of the Fe-based alloy particle was measured according to the method described above.

As a result, in all of the samples, the content percentage of the crystal phase in the structure of the Fe-based alloy particle was in a range of from 50% by volume to 80% by volume.

Measurement of Saturation Magnetization and Coercive Force

With regard to each of the samples after heat treatment, magnetization measurement was performed to obtain a hysteresis loop. From the obtained hysteresis loop, the saturation magnetization (emu/g) at an applied magnetic field of 800 kA/m and the coercive force (A/m) at an applied magnetic field of 40 kA/m were determined, respectively.

The magnetization measurement was conducted using a VSM (a vibrating sample magnetometer, VSM-5 (trade name), manufactured by TOEI INDUSTRY CO., LTD.).

The results are shown in Table 2.

TABLE 2

| | | Heat Treatment | | | | | | | | |
|---|---|---|---|---|---|---|---|---|---|---|
| No. | Comp.. | Temp. E. Rate (° C./hr) | KT (° C.) | HT (hr) | Cr. T (° C.) | Atomospher | Ox. D | C. F | S. Mag | AGS (nm) |
| 1 | A | 100 (RT~KT) | 550 | 1 | 540 | $N_2$ | 0.005 | 55 | 116 | 12 |
| *2 | B | 100 (RT~KT) | 500 | 1 | 500 | $N_2$ | 0.005 | 331 | 130 | 22 |
| *3 | | | | | | | | 457 | 129 | 23 |
| *4 | | | | | | | | 1274 | 128 | 42 |
| 5 | C | 100 (RT~KT) | 500 | 1 | 500 | $N_2$ | 0.005 | 89 | 125 | 15 |
| 6 | | | | | | | | 158 | 124 | 14 |
| *7 | | | | | | | | 262 | 124 | 15 |
| *8 | D | none | none | none | 500 | none | none | 318 | 137 | amorphous |
| 9 | | 100 (RT~KT) | 490 | 1 | 500 | $N_2$ | 0.005 | 116 | 135 | 22 |
| 10 | | | | | | | | 81 | 135 | 23 |
| 11 | | | | | | | | 95 | 135 | 21 |
| 12 | | | | | | | | 185 | 134 | 21 |
| *13 | | | | | | | | 278 | 133 | 21 |
| 14 | | 100 (RT~KT) | 490 | 1 | 500 | $N_2$ | 0.3 | 86 | 135 | 23 |
| 15 | | 100 (RT~KT) | 490 | 1 | 500 | Air | 20.4 | 86 | 135 | 23 |
| 16 | | | 510 | 1 | 500 | Air | 20.4 | 71 | 133 | 25 |
| 17 | | 100 (RT~390° C.)<br>20 (390° C.~KT) | 490 | 1 | 500 | $N_2$ | 0.005 | 82 | 135 | 25 |
| 18 | E | 100 (RT~KT) | 520 | 1 | 520 | $N_2$ | 0.005 | 106 | 124 | 11 |
| 19 | | | | | | | | 129 | 125 | 10 |
| *20 | | | | | | | | 248 | 125 | 11 |

In Table 2, the abbreviation "Comp" denotes "the composition", the abbreviation "Temp.E.Rate" denotes "the temperature elevating rate", the abbreviation "KT" denotes "the holding temperature KT", the abbreviation "HT" denotes "the holding time", the abbreviation "Cr.T" denotes "the crystallization temperature", the abbreviation "Ox.D" denotes "the oxygen density (% by volume)", the abbreviation "C.F" denotes "the coercive force (A/m)", the abbreviation "S.Mag" denotes "the saturation magnetization (emu/g)", and the abbreviation "AGS" denotes "the average grain size (nm) of the nanocrystal grains".

Sample Nos. 21 to 25

Sample Nos. 21 to 25 after classification but before heat treatment were obtained by a method substantially similar to that in Sample No. 1 after classification but before heat treatment, except that the powdering of the molten alloy by a water atomization method was changed to powdering of the molten alloy by a high speed combustion flame atomization method, and that the conditions for classification were adjusted.

In the high speed combustion flame atomization method, the temperature of the flame jet injected through the jetting means was 1,300° C., and the drop rate of the molten alloy as the raw material was 5 kg/min. Water was used as the cooling medium, and this cooling medium (water) was injected in the form of a liquid mist through the cooling means. The cooling rate of the molten alloy was adjusted by adjusting the injection amount of water to be within the range of from 4.5 L/min (liter per minute) to 7.5 L/min.

Classification

The conditions for classification in Sample Nos. 21 to 25 are as follows.

Classification Using Sieve (First Classification)

Similar to the case of Sample No. 1, the amorphous Fe-based alloy powder before classification was passed through a sieve having an opening of 250 μm, whereby a group of coarse particles was removed from the amorphous Fe-based alloy powder.

Classification Using Centrifugal Air Flow Type Classifier (Second Classification)

In Sample Nos. 21, 22, 24, and 25, with respect to the amorphous Fe-based alloy powder after the first classification, using a centrifugal air flow type classifier (TC-15 (trade name), manufactured by Nissin Engineering Inc.), a second classification (overcut) on the conditions shown in Table 3 and a second classification (undercut) on the conditions shown in Table 3 were performed in this order. That is, with respect to the amorphous Fe-based alloy powder after the first classification, first, a group of large particles was removed by performing a second classification (overcut), and then, a group of small particles was removed by performing a second classification (undercut) with respect to the amorphous Fe-based alloy powder that had been subjected to the second classification (overcut).

In Sample No. 23, with respect to the amorphous Fe-based alloy powder after the first classification, using a centrifugal air flow type classifier (TC-15 (trade name), manufactured by Nissin Engineering Inc.), only a second classification (overcut) on the conditions shown in Table 3 was performed (that is, a second classification (undercut) was not performed).

Various Measurements

With regard to Sample Nos. 21 to 25 after classification but before heat treatment, each of d10, d50, d90, (d90−d10)/d50, the ratio (% by volume) of particles having a particle diameter of 2 μm or less, and the ratio (% by volume) of particles having a particle diameter of 5 μm or less was measured according to the methods described above.

The results are shown in Table 3.

Heat Treatment

With respect to Sample No. 21 after classification but before heat treatment, heat treatment was performed on the conditions similar to the conditions for the heat treatment with respect to Sample No. 1, thereby obtaining Sample No. 21 after heat treatment.

With regard to Sample No. 21 after heat treatment, the measurement of average grain size of nanocrystal grains and the measurement of saturation magnetization and coercive force were performed, respectively, according to the measurement methods similar to the measurement methods with respect to Sample No. 1 after heat treatment.

The results are shown in Table 4.

Further, with respect to Sample Nos. 22 to 25 after classification but before heat treatment, operations substantially similar to the operations (heat treatment and various measurements) with respect to Sample No. 21 after classification but before heat treatment were conducted, except that the holding time was changed as shown in Table 4.

The results are shown in Table 4.

TABLE 3

| | | | Second Classification (overcut) | | | Second Classification (undercut) | | | | | Particle size (μm) | | | (d90 − d10)/ |
|---|---|---|---|---|---|---|---|---|---|---|---|---|---|---|
| No. | Composition | CPFA | AQ ($m^3$/s) | NR (rpm) | SSP (kg/h) | AQ ($m^3$/s) | NR (rpm) | SSP (kg/h) | RPS 2 μm | RPS 5 μm | d10 | d50 | d90 | d50 |
| 21 | A | absent | 2.5 | 1000 | 3 | 2.5 | 2800 | 3 | 0.00 | 0.85 | 8.7 | 19.6 | 38.2 | 1.50 |
| 22 | | absent | 2.8 | 1000 | 3 | 2.8 | 2000 | 3 | 0.00 | 0.00 | 16.4 | 26.1 | 44.0 | 1.06 |
| 23 | | absent | 2.5 | 3000 | 3 | — | — | — | 6.84 | 72.05 | 2.2 | 4.0 | 6.5 | 1.08 |
| 24 | | absent | 2.8 | 2000 | 3 | 2.5 | 3000 | 3 | 0.00 | 2.44 | 6.4 | 10.1 | 17.8 | 1.12 |
| 25 | | absent | 2.8 | 1000 | 3 | 2.5 | 2000 | 3 | 0.00 | 0.00 | 15.8 | 26.0 | 44.6 | 1.11 |

In Table 3, the abbreviation "CPRA" denotes "presence or absence of the crystal phase in the Fe-based alloy", the abbreviation "AQ" denotes "air quantity of the blower", the abbreviation "NR" denotes "the number of revolutions of the classifying rotor", the abbreviation "SSP" denotes "the supply speed of the powder", the abbreviation "RPS 2 μm" denotes "the ratio (% by volume) of particles having a particle diameter of 2 μm or less", and the abbreviation "RPS 5 μm" denotes "the ratio (% by volume) of particles having a particle diameter of 5 μm or less".

TABLE 4

| No. | Comp | Heat Treatment Temp. E. Rate (° C./hr) | KT (° C.) | HT (hr) | Cr. T (° C.) | Atomospher | Ox. D | C. F | S. Mag | AGS (nm) |
|---|---|---|---|---|---|---|---|---|---|---|
| 21 | A | 100 (RT~KT) | 550 | 1 | 540 | $N_2$ | 0.005 | 35 | 120 | 12 |
| 22 | | | 530 | | | | | 10 | 117 | 13 |
| 23 | | | | | | | | 105 | 117 | 14 |
| 24 | | | | | | | | 18 | 117 | 13 |
| 25 | | | | | | | | 14 | 117 | 14 |

In Table 4, the abbreviation "Comp" denotes "the composition", the abbreviation "Temp.E.Rate" denotes "the temperature elevating rate", the abbreviation "KT" denotes "the holding temperature KT", the abbreviation "HT" denotes "the holding time", the abbreviation "Cr.T" denotes "the crystallization temperature", the abbreviation "Ox.D" denotes "the oxygen density (% by volume)", the abbreviation "C.F" denotes "the coercive force (A/m)", the abbreviation "S.Mag" denotes "the saturation magnetization (emu/g)", and the abbreviation "AGS" denotes "the average grain size (nm) of the nanocrystal grains".

As shown in Tables 1 to 4, in the samples after heat treatment according to the examples of the invention (in detail, Sample Nos. 1, 5, 6, 9 to 12, 14 to 19, and 21 to 25), each being a crystalline Fe-based alloy powder composed of Fe-based alloy particles including, within the structure, nanocrystal grains having an average grain size of 30 nm or less, and each having d50 of from 3.5 μm to 35.0 μm and a ratio of particles having a particle diameter of 2 μm or less of from 0% by volume to 8% by volume, the coercive force was reduced. In more detail, in the samples after heat treatment according to the examples of the invention, the coercive force was 190 A/m or less at an applied magnetic field of 40 kA/m.

In contrast, in Sample No. *4, having an average grain size of nanocrystal grains of more than 30 nm, the coercive force was increased (see Table 2).

Further, also in Sample Nos. *2, *3, *7, *13, and *20, each having a ratio of particles having a particle diameter of 2 μm or less of more than 8% by volume, the coercive force was increased (see Table 2).

Furthermore, also in Sample No. *8, being an amorphous Fe-based alloy powder, the coercive force was increased (see Table 2).

In Sample Nos. 1, 5, 9 to 11, 14 to 19, and 21 to 25, each having a ratio of particles having a particle diameter of 2 μm or less of from 0% by volume to 7% by volume, the coercive force was further reduced. Specifically, in these samples, the coercive force was 130 A/m or less.

In Sample Nos. 1, 21, 22, 24 and 25, each having d50 of more than 5.0 μm but 35.0 μm or less and a ratio of particles having a particle diameter of 5 μm or less of from 0% by volume to 8% by volume, the coercive force was further reduced. Specifically, in these samples, the coercive force was 60 A/m or less.

Among these samples, in Sample Nos. 21, 22, 24, and 25, each having a ratio of particles having a particle diameter of 5 μm or less of from 0% by volume to 5% by volume, the coercive force was further reduced. Specifically, in these samples, the coercive force was 40 A/m or less.

Further, in Sample Nos. 10 and 14 to 17, being the same in terms of alloy composition and particle diameter but being different in terms of the conditions (the temperature conditions, the atmosphere) for heat treatment, substantially, no difference was seen in the saturation magnetization. Among Sample Nos. 10 and 14 to 17, in No. 16 in which the holding temperature was high, the coercive force was remarkably reduced.

In more detail, among Sample Nos. 10 and 14 to 17, in Sample Nos. 15 and 16, in which heat treatment had been performed in an air atmosphere including oxygen, the saturation magnetization was substantially equivalent to the saturation magnetization in Sample Nos. 10, 14, and 17, in which heat treatment had been performed in a $N_2$ atmosphere scarcely including oxygen. The reason for this is thought as follows. Namely, the oxide film which is present at the surface layer part of the amorphous Fe-based alloy particle that constitutes the amorphous Fe-based alloy powder functions as a protective film against the heat treatment and thus, the progress of oxidization at the time of heat treatment is suppressed.

The fact that it is possible to perform heat treatment in an air atmosphere including oxygen means that it is not necessary to control the atmosphere in the heat treatment. Thus, the fact that it is possible to perform heat treatment in an air atmosphere including oxygen contributes to the improvement in productivity of the crystalline Fe-based alloy powder and a decrease in production costs.

Further, each sample after heat treatment (that is, the crystalline Fe-based alloy powder) was observed at a magnification of from 100× to 5,000× using a scanning type microscope (SEM, S-4700 (trade name), manufactured by Hitachi, Ltd.).

As a result, in each sample, the shape of each particle was a shape surrounded by a curved surface. In detail, in all of the samples, a particle having a spherical shape, a particle having an approximately spherical shape, a particle having a teardrop-like shape, and a particle having a gourd-like shape were included.

FIG. 1 is a SEM photograph of Sample No. 25 after heat treatment (crystalline Fe-based alloy powder) taken at a magnification of 5,000×.

As shown in FIG. 1, Sample No. 25 is mainly constituted by particles having a spherical shape and particles having an approximately spherical shape, and contains a particle having a teardrop-like shape and a particle having a gourd-like shape.

Figure 2:
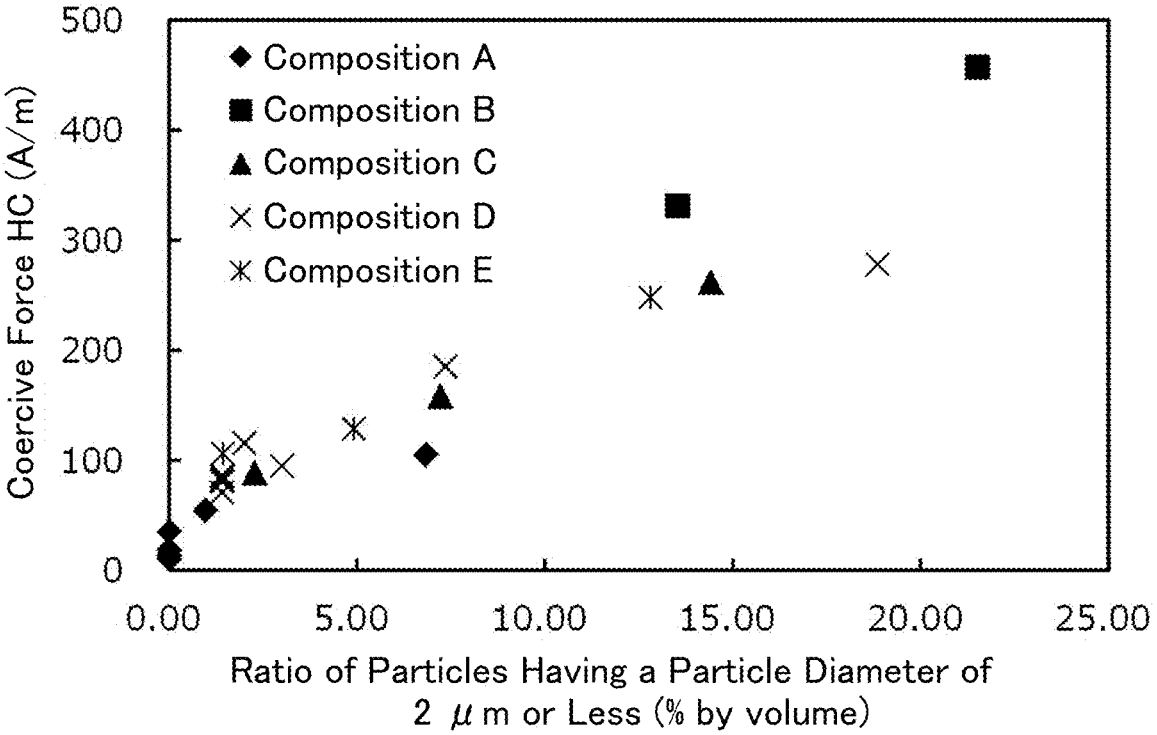
FIG. 2 is a graph showing the relationship between the ratio of particles having a particle diameter of 2 μm or less and the coercive force in Sample No. 1 to No. 25 (however, Sample No. *4 and Sample No. *8 are excluded), in the Examples of the disclosure.

FIG. 2 is a graph showing the relationship between the ratio of particles having a particle diameter of 2 μm or less and the coercive force in Sample No. 1 to No. 25 (however, Sample No. *4 and Sample No. *8 are excluded). In FIG. 2, the type of plots is changed by the composition of the Fe-based alloy.

From FIG. 2, it is understood that, in any composition, there is a tendency that the coercive force lowers, when the ratio of particles having a particle diameter of 2 μm or less gets lower (specifically, when the ratio is from 0% by volume to 8% by volume).

Figure 3:
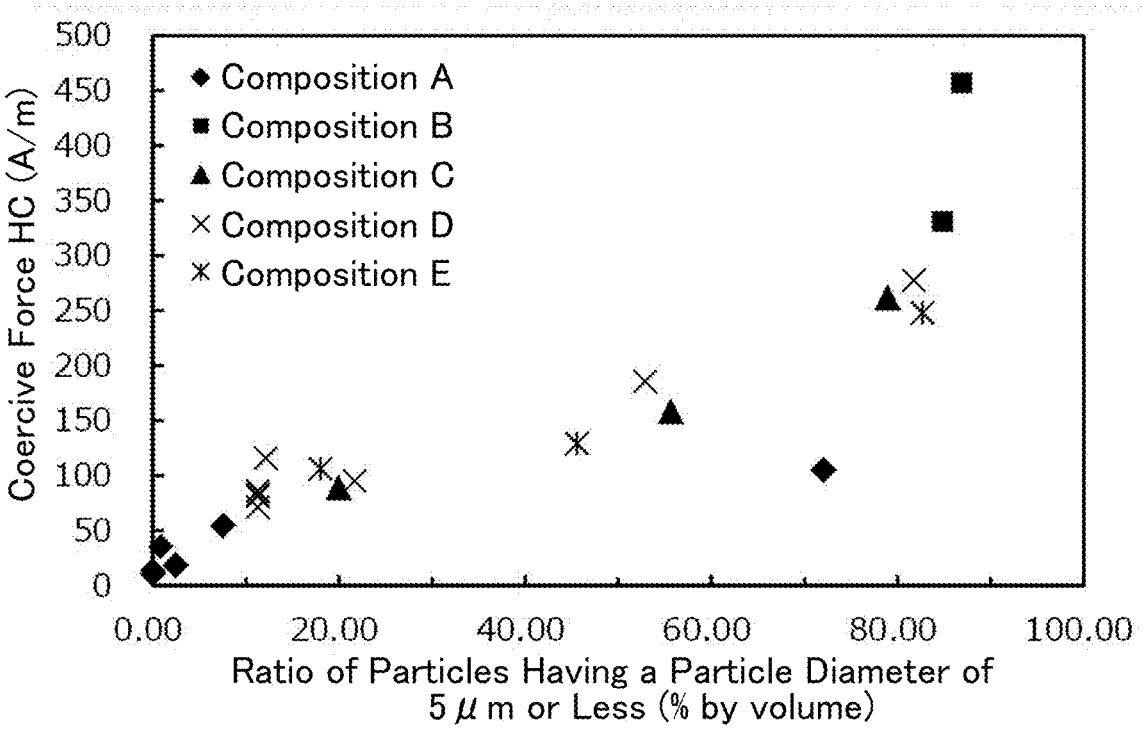
FIG. 3 is a graph showing the relationship between the ratio of particles having a particle diameter of 5 μm or less and the coercive force in Sample No. 1 to No. 25 (however, Sample No. *4 and Sample No. *8 are excluded), in the Examples of the disclosure.

FIG. 3 is a graph showing the relationship between the ratio of particles having a particle diameter of 5 μm or less and the coercive force in Sample No. 1 to No. 25 (however, Sample No. *4 and Sample No. *8 are excluded). Also in FIG. 3, the type of plots is changed by the composition of the Fe-based alloy.

From FIG. 3, it is understood that, in any composition, there is a tendency that the coercive force lowers, when the ratio of particles having a particle diameter of 5 μm or less gets lower (specifically, when the ratio is from 0% by volume to 8% by volume).

Figure 4:
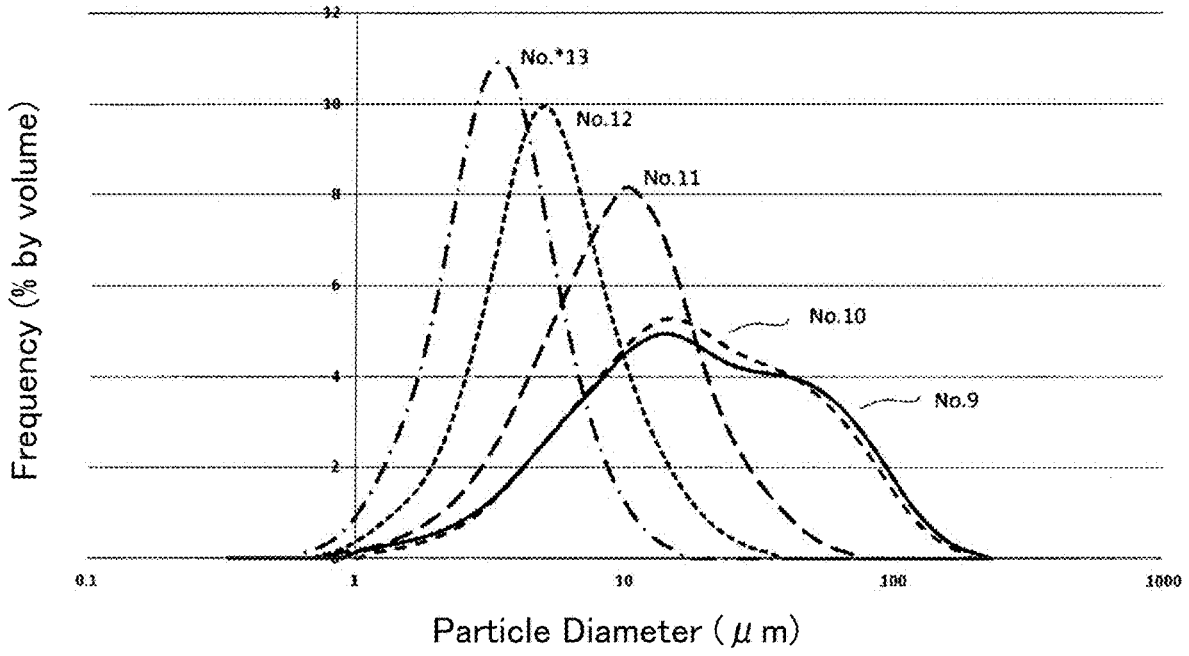
FIG. 4 is a particle size distribution diagram of Sample No. 9, Sample No. 10, Sample No. 11, Sample No. 12, and Sample No. *13 (comparative example) in the Examples of the disclosure.

FIG. 4 is a particle size distribution diagram of Sample Nos. 9, 10, 11, and 12 and No. *13, which have the same alloy composition.

When focusing on Sample Nos. 9 and 10, which have a similar particle size distribution, and comparing the coercive forces of these samples in Table 2, it is understood that the coercive force of Sample No. 10, in which the ratio of particles having a particle diameter of 2 μm or less is low, is smaller than the coercive force of Sample No. 9, in which the ratio of particles having a particle diameters diameter of 2 μm or less is high.

Further, when focusing on Sample Nos. 10 to 12, in which the particle size distribution is remarkably different and (d90-d10)/d50 (see Table i) is remarkably different, and comparing the coercive forces of these samples in Table 2, a clear correlation is not seen between (d90-d10)/d50 and the coercive force. Also in Sample Nos. 10 to 12, it is understood that the coercive forces of Sample Nos. 10 and 11, in which the ratio of particles having a particle diameter of 2 μm or less is low, are smaller than the coercive force of Sample No. 12, in which the ratio of particles having a particle diameter of 2 μm or less is high.

Further, concerning the samples having the same composition, even in a case in which the heat treatment conditions were different, a substantial difference was not seen in the saturation magnetization.

Evaluation of Magnetostriction Constant

With regard to powder, it is difficult to directly measure the magnetostriction constant.

Accordingly, as a substitute test for estimating the magnetostriction constant of each sample after heat treatment (powder), with regard to a thin strip having a structure similar to the structure of each sample after heat treatment, the magnetostriction constant was measured.

In detail, using an ingot having the alloy composition described above, an amorphous Fe-based alloy thin strip having a thickness of 15 μm and a width of 5 mm was prepared by a single roll method. The quenching in the single roll method was performed in an Ar gas. The amorphous Fe-based alloy thin strip thus obtained was heat treated on the conditions shown in Table 5, thereby obtaining a crystalline Fe-based alloy thin strip.

TABLE 5

| | Composition | Heat Treatment | | |
|---|---|---|---|---|
| | | Temp.E.Rate (° C./hr) | KT (° C.) | HT (hr) |
| A | $Fe_{70.5}Cu_{1.0}Si_{13.5}B_{11.0}Nb_{3.0}Cr_{1.0}$ | 100 (RT~KT) | 550 | 1 |
| B | $Fe_{74.4}Cu_{1.0}Si_{13.5}B_{7.6}Nb_{2.5}Cr_{1.0}$ | 100 (RT~KT) | 500 | 1 |

TABLE 5-continued

| | Composition | Heat Treatment | | |
|---|---|---|---|---|
| | | Temp.E.Rate (° C./hr) | KT (° C.) | HT (hr) |
| C | $Fe_{72.5}Cu_{1.0}Si_{13.5}B_{9.0}Mo_{3.0}Cr_{1.0}$ | 100 (RT~KT) | 500 | 1 |
| D | $Fe_{72.5}Cu_{1.0}Si_{13.5}B_{11.0}Mo_{1.0}Cr_{1.0}$ | 100 (RT~KT) | 490 | 1 |
| E | $Fe_{72.5}Cu_{1.0}Si_{13.5}B_{9.0}Nb_{3.0}Cr_{1.0}$ | 100 (RT~KT) | 520 | 1 |

In Table 5, the abbreviation "Temp.E.Rate" denotes "the temperature elevating rate", the abbreviation "KT" denotes "the holding temperature KT", and the abbreviation "HT" denotes "the holding time".

Each of the obtained crystalline Fe-based alloy thin strips contained, in the structure, nanocrystal grains having an average grain size of 30 nm or less.

The magnetostriction constant of each crystalline Fe-based alloy thin strip was measured. As a result, the magnetostriction constants of all the crystalline Fe-based alloy thin strips were within the range of from 0 to $+2\times10^{-6}$.

Accordingly, it is guessed that each sample after heat treatment (that is, the crystalline Fe-based alloy powder) also has a similar magnetostriction constant.

Each sample after heat treatment (that is, the crystalline Fe-based alloy powder) excellent in magnetic property (magnetostriction constant) as described above is suitable as a material for a magnetic core (for example, a dust core, a metal composite core, or the like).

Namely, each sample after heat treatment (that is, the crystalline Fe-based alloy powder) is expected to contribute to the improvement in the characteristics of an inductor, a noise filter, a choke coil, a transformer, or a reactor, which uses the magnetic core described above.

The disclosure of Japanese Patent Application No. 2017-152561 filed on Aug. 7, 2017 is incorporated by reference herein in its entirety.

All publications, patent applications, and technical standards mentioned in this specification are herein incorporated by reference to the same extent as if such individual publication, patent application, or technical standard was specifically and individually indicated to be incorporated by reference.

The invention claimed is:

1. A crystalline Fe-based alloy powder composed of Fe-based alloy particles that comprise, within a structure thereof, nanocrystal grains having an average grain size of 30 nm or less, wherein:

d50, which is a particle diameter corresponding to a cumulative frequency of 50% by volume, is from 3.5 μm to 35.0 μm in a cumulative distribution curve based on laser diffractometry and that shows a relationship between a particle diameter and a cumulative frequency from a small particle diameter side;

a ratio of Fe-based alloy particles having a particle diameter of 2 μm or less to a total of the Fe-based alloy particles, which is based on the laser diffractometry, is from 0% by volume to 8% by volume;

a ratio of Fe-based alloy particles having a particle diameter of 5 μm or less to a total of the Fe-based alloy particles is from 0% by volume to 72.05% by volume;

the Fe-based alloy particles comprise an oxide film at a surface layer part: and a film thickness of the oxide film is in a range of from 2 nm to less than 50 nm and wherein the oxide film includes Fe, Si Cu and B.

2. The crystalline Fe-based alloy powder according to claim 1, wherein, in the cumulative distribution curve, in a case in which d10 is a particle diameter corresponding to a cumulative frequency of 10% by volume and d90 is a particle diameter corresponding to a cumulative frequency of 90% by volume, (d90-d10)/d50 is from 1.00 to 4.00.

3. The crystalline Fe-based alloy powder according to claim 1, wherein a coercive force at an applied magnetic field of 40 kA/m is 190 A/m or less.

4. The crystalline Fe-based alloy powder according to claim 1, wherein the ratio of Fe-based alloy particles having a particle diameter of 2 μm or less to the total of the Fe-based alloy particles is from 0% by volume to 7% by volume.

5. The crystalline Fe-based alloy powder according to claim 1, wherein:

d50 is more than 8.0 μm and less than or equal to 35.0 μm; and a ratio of Fe-based alloy particles having a particle diameter of 5 μm or less to the total of the Fe-based alloy particles, which is determined by laser diffractometry, is from 0% by volume to 8% by volume.

6. The crystalline Fe-based alloy powder according to claim 5, wherein the ratio of Fe-based alloy particles having a particle diameter of 5 μm or less to the total of the Fe-based alloy particles is from 0% by volume to 5% by volume.

7. The crystalline Fe-based alloy powder according to claim 1, wherein a composition of the Fe-based alloy particles comprises Cu, Si, and B, and at least one of Nb or Mo, with a remainder comprising Fe and impurities.

8. The crystalline Fe-based alloy powder according to claim 7, wherein the composition of the Fe-based alloy particles further comprises chromium, and is such that, in a case in which a total content of Cu, Si, B, Nb, Mo, Cr, and Fe is 100 atom %, a content of Cu is from 0.1 atom % to 3.0 atom %, a content of Si is from 13.0 atom % to 16.0 atom %, a content of B is 7.0 atom % or more and less than 12.0 atom %, a total content of Nb and Mo is more than 0 atom % and less than or equal to 6.0 atom %, and a content of Cr is more than 0 atom % to 5.0 atom %.

9. The crystalline Fe-based alloy powder according to claim 8, wherein a content of Mo is more than 0 atom % and less than 4.0 atom %.

10. A method for producing a crystalline Fe-based alloy powder, the method being a method for producing the crystalline Fe-based alloy powder according to claim 7, wherein the method comprises:

obtaining an amorphous Fe-based alloy powder composed of amorphous Fe-based alloy particles by an atomization method; and performing classification and heat treatment in this order, or performing heat treatment and classification in this order, with respect to the amorphous Fe-based alloy powder, thereby obtaining the crystalline Fe-based alloy powder.

11. The method for producing a crystalline Fe-based alloy powder according to claim 10, wherein the classification comprises a first classification, which is performed using a sieve, and a second classification, which is performed using a centrifugal air flow classifier, after the first classification.

12. The crystalline Fe-based alloy powder according to claim 2, wherein a coercive force at an applied magnetic field of 40 kA/m is 190 A/m or less.

13. The crystalline Fe-based alloy powder according to claim 12, wherein the ratio of Fe-based alloy particles having a particle diameter of 2 μm or less to the total of the Fe-based alloy particles is from 0% by volume to 7% by volume.

14. The crystalline Fe-based alloy powder according to claim 12, wherein the ratio of Fe-based alloy particles having a particle diameter of 5 μm or less to the total of the Fe-based alloy particles is from 0% by volume to 5% by volume.

15. The crystalline Fe-based alloy powder according to claim 12, wherein a composition of the Fe-based alloy particles comprises Cu, Si, and B, and at least one of Nb or Mo, with a remainder comprising Fe and impurities.

16. The crystalline Fe-based alloy powder according to claim 15, wherein the composition of the Fe-based alloy particles further comprises chromium, and is such that, in a case in which a total content of Cu, Si, B, Nb, Mo, Cr, and Fe is 100 atom %, a content of Cu is from 0.1 atom % to 3.0 atom %, a content of Si is from 13.0 atom % to 16.0 atom %, a content of B is 7.0 atom % or more and less than 12.0 atom %, a total content of Nb and Mo is more than 0 atom % and less than or equal to 6.0 atom %, a content of Cr is from more than 0 atom % to 5.0 atom %.

* * * * *